US006514654B1

(12) United States Patent
Kanbayashi et al.

(10) Patent No.: US 6,514,654 B1
(45) **Date of Patent: *Feb. 4, 2003**

(54) TWO-COMPONENT DEVELOPER AND IMAGE FORMING METHOD

(75) Inventors: Makoto Kanbayashi, Shizuoka-ken (JP); Hirohide Tanikawa, Shizuoka-ken (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/288,711

(22) Filed: Apr. 9, 1999

(30) Foreign Application Priority Data

Apr. 10, 1998 (JP) ..... 10-098864
Mar. 29, 1999 (JP) ..... 11-085506

(51) Int. Cl.[7] ..... G03G 13/09
(52) U.S. Cl. ..... 430/122; 430/108.3
(58) Field of Search ..... 430/110, 109, 430/126, 108.3, 122

(56) References Cited

U.S. PATENT DOCUMENTS

| | | | | |
|---|---|---|---|---|
| 4,859,716 A | * | 8/1989 | Ibsen et al. | 522/14 |
| 4,886,730 A | | 12/1989 | Ota et al. | 430/137 |
| 5,200,288 A | | 4/1993 | Ando et al. | 430/110 |
| 5,707,770 A | * | 1/1998 | Tanikawa et al. | 430/110 |
| 5,747,209 A | | 5/1998 | Takiguchi et al. | 430/106.6 |
| 6,007,958 A | * | 12/1999 | Ito et al. | 430/109 |
| 6,218,965 B1 | * | 4/2001 | Tanikawa et al. | 430/110 |

FOREIGN PATENT DOCUMENTS

| | | |
|---|---|---|
| EP | 0606100 | 7/1994 |
| EP | 0921442 | 6/1999 |
| JP | 53-127726 | 11/1978 |
| JP | 57-104940 | 6/1982 |
| JP | 57-111541 | 7/1982 |
| JP | 61-069073 | 4/1986 |
| JP | 61-073963 | 4/1986 |
| JP | 61-267058 | 11/1986 |
| JP | 62-105156 | 5/1987 |
| JP | 62-145255 | 6/1987 |
| JP | 62-163061 | 7/1987 |
| JP | 57-124357 | 8/1987 |
| JP | 63-208865 | 8/1988 |
| JP | 3-276166 | 12/1991 |
| JP | 4-084141 | 3/1992 |
| JP | 8-160668 | 6/1996 |

OTHER PUBLICATIONS

Borsenberger, Paul M. et al. Organic Photoreceptors for Imaging Systems. New York: Marcel–Dekker, Inc., pp. 6–17, 1993.*

Database WP1, Section Ch, Wk 9311, Derwent, AN93–089545.

Database WP1, Section Ch, Wk 8336, Derwent, AN83–755975.

Database WP1, Section Ch, Wk 7742, Derwent, AN77–75133Y.

Database WP1, Section Ch, Wk 9923, Derwent, AN99–276940.

* cited by examiner

*Primary Examiner*—Christopher Rodee
(74) *Attorney, Agent, or Firm*—Fitzpatrick, Cella, Harper & Scinto

(57) ABSTRACT

A two-component developer is formed as a mixture of a negatively chargeable toner and a resin-coated carrier. The toner comprises at least a binder resin, a colorant and an organic metal compound. The organic metal compound is an organic zirconium compound having a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids. The toner further includes an external additive comprising hydrophobized inorganic fine powder having an average primary particle size of 0.001–0.2 μm. The resin-coated carrier has a 50%-particle size of 20–70 μm.

23 Claims, 3 Drawing Sheets

TWO-COMPONENT DEVELOPER AND IMAGE FORMING METHOD

FIELD OF THE INVENTION AND RELATED ART

The present invention relates to a two-component developer comprising a toner and a carrier for developing electrostatic images for use in electrophotography, electrostatic recording and electrostatic printing, and an image forming method using the two-component developer.

In accordance with the recent spread of computer appliances for personal users, full-color image communication as an image data communication scheme is also being widely used. Under such circumstances, conversion into full-color models is rapidly promoted principally in the marketing of lower-grade machines of printers and copying machines as data outputting means.

Various techniques employing such full-color outputting machines are known, inclusive of electrophotography, thermal transfer, ink ribbon, and ink jetting. In electrophotography, generally an electrostatic latent image is formed on a photosensitive member using a photoconductive substance and the latent image is then developed with a toner to form a toner image. The thus-formed toner image is, after being transferred onto a transfer(-receiving) material such as paper as desired, fixed by using fixing means as by application of heat, pressure, heat and pressure, or solvent vapor, to form a color image.

Full-color image formation according to full-color electrophotography is generally effected by color reproduction with color toners of three primary colors of yellow, magenta and cyan or four color toners further including a black toner. More specifically, in a full-color image forming method for example, light from an original is caused to pass through a color separation filter having a color complementary to that of a toner, and laser light based on the light having passed through the filter is caused to illuminate a photoconductor layer to form an electrostatic latent image for, e.g., a magenta image. The latent image is then developed with a magenta toner and the resultant magenta toner image is transferred onto a support material. The above-mentioned steps are repeated also by using a cyan toner, a yellow toner and black toner while effecting registration to form superposed color toner images, which are usually transferred onto a transfer-receiving material, such as paper, and then fixed to provide a final full-color image, e.g., in a hot-pressure fixation step.

When a toner is blended with a carrier to provide a two-component developer, the toner is generally charged to a polarity and in a charged amount as desired by triboelectrification with the carrier and is used to develop the electrostatic image by utilizing an electrostatic attractive force. Accordingly, in order to obtain a good visible image, the toner is principally required to have a good triboelectric chargeability.

For the above problem, many studies have been made for realizing excellent triboelectric chargeability based on improvements of developer constituent materials, such as selection of carrier core material and selection of carrier coating materials, optimization of carrier coating amounts, section of charge control agents and flowability improving agents added to the toner, and an improvement of binder resin as a toner matrix material. In recent years, there has been an increasing demand for higher resolution and higher image quality of image forming apparatus, such as copying machines and printers in the market, and as a solution for complying with the demand, the use of a smaller particle size of color toner has been proposed to realize high-quality color image formation. As the toner particle size is reduced, the chargeability of the toner tends to be increased due to increase in surface area per unit weight thereof, thus being liable to cause a reduction in image density and inferior continuous image forming performance. Moreover, due to a large chargeability of the toner, a strong attachment force acts between toner particles, thus causing a lower flowability and problems in stability of toner replenishment and triboelectrification of the replenished toner.

Further, in the case of a color toner containing no dark electroconductive substance, such as magnetic material or carbon black, charge-leakage sites are liable to be insufficient, so that the toner tends to have a large chargeability. This tendency is particularly noticeable when a polyester-based binder having a high negative chargeability is used.

Particularly, the following properties (1)–(3) are strongly desired of a color toner.

(1) A fixed color toner image is placed in such a substantially completely melted state as to make individual toner particles undiscriminatable.

(2) A color toner forming an upper color toner layer has a sufficient transparency not to hinder the hue of a lower layer-forming different color toner.

(3) Respective color toners have a good balance of hue and spectral reflection characteristics and also a good saturation.

From these viewpoints, studies have been made on various binder resins, and color toners satisfying the above-mentioned performances are still desired. In the field of electrophotography today, polyester resins are frequently used as binder resins for color toners, but a color toner comprising a polyester is generally susceptible to temperature and humidity and is liable to cause an excessive charge in a low humidity environment and an insufficient charge in a high humidity environment, so that a color toner exhibiting a stable chargeability in wide variety of environments is still desired.

A toner can be charged by utilizing a triboelectric chargeability of a resin as a toner component, but the toner chargeability in this case is unstable so that the resultant image density cannot be raised quickly at the start of image formation and the resultant images are liable to be foggy. For this reason, frequently a charge control agent has been added to the toner to provide the toner with a desired triboelectric chargeability.

The charge control agents known in the art nowadays include: negatively chargeable charge control agents inclusive of metal complex salts of monoazo dyes; metal complex salts of hydroxycarboxylic acids, dicarboxylic acids and aromatic diols; and resins containing an acidic component. On the other hand, known positively chargeable charge control agents include: nigrosine dyes, azine dyes, triphenylmethane dyes and pigments, quaternary ammonium salts, and polymers having a quaternary ammonium salt as a side chain.

However, most of such known charge control agents applicable to color toners have functionally unsatisfactory points still remaining, such as difficulty in formation of uniform highlight images and a large fluctuation in image density during continuous image formation.

Other points to be further improved may include: a difficulty in obtaining a good balance between image density and fog prevention, a difficulty in obtaining a sufficient image density in a high humidity environment, a poor dispersibility in a resin, and adverse effects on storage stability, fixability and anti-offset property of the resultant toner.

As known charge control agents, metal complexes or metal salts of aromatic carboxylic acids have been proposed in Japanese Laid-Open Patent Application (JP-A) 53-127726, JP-A 57-111541, JP-A 57-124357, -JP-A 57-104940, JP-A 61-69073, JP-A 61-73963, JP-A 61-267058, JP-A 62-105156, JP-A 62-145255, JP-A 62-163061, JP-A 63-208865, JP-A 3-276166, JP-A 4-84141, and JP-A 8-160668. Charge control agents proposed in these references are generally excellent in performance of imparting triboelectric chargeability, but few of them are satisfactory in providing a stable developing performance regardless of environmental condition change, continued use and condition of use even when used in a simple developing device structure. Few of them provide a stable developing performance in a long term of continuous image formation when used in a high-speed image forming machine. Further, many of them are affected by other toner materials, thus posing a constraint on the selection of such other toner materials.

SUMMARY OF THE INVENTION

An object of the present invention is to provide a two-component developer capable of providing high-quality images in both low- and high-humidity environments and not causing image defects with lapse of time.

Another object of the present invention is to provide a two-component developer capable of providing fog-free clear images and exhibiting excellent stability in continuous image formation.

Another object of the present invention is to provide a two-component developer exhibiting excellent flowability and capable of providing toner images which faithfully reproduce latent images and excellent transferability.

Another object of the present invention is to provide a two-component developer less liable to be affected by changes in environmental conditions such as temperature and humidity and thus capable of exhibiting stable triboelectric chargeability and causing little filming or soiling on the photosensitive member.

Another object of the present invention is to provide a two-component developer exhibiting excellent fixability and capable of providing an OHP film of excellent transparency.

Another object of the present invention is to provide a two-component developer less liable to fade and exhibiting excellent light-fasteners.

A further object of the present invention is to provide an image forming method using such a two-component developer as described above.

According to the present invention, there is provided a two-component developer, comprising: a negatively chargeable toner and a resin-coated carrier; wherein the toner comprises at least a binder resin, a colorant and an organic metal compound, the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids, the toner includes an external additive comprising hydrophobized inorganic fine powder having an average primary particle size of 0.001–0.2 μm, and the resin-coated carrier has a 50%-particle size of 20–70 μm.

According to another aspect of the present invention, there is provided an image forming method, comprising:

(I) a charging step of charging an image-bearing member, (II) a latent image-forming step of forming an electrostatic latent image on the charged image-bearing member, (III) a developing step of developing the latent image on the image-bearing member with the negatively chargeable toner in the above-mentioned two-component developer of the present invention to form a toner image on the image-bearing member, and (IV) a transfer step of transferring the toner image onto a transfer-receiving material via or without via an intermediate transfer member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
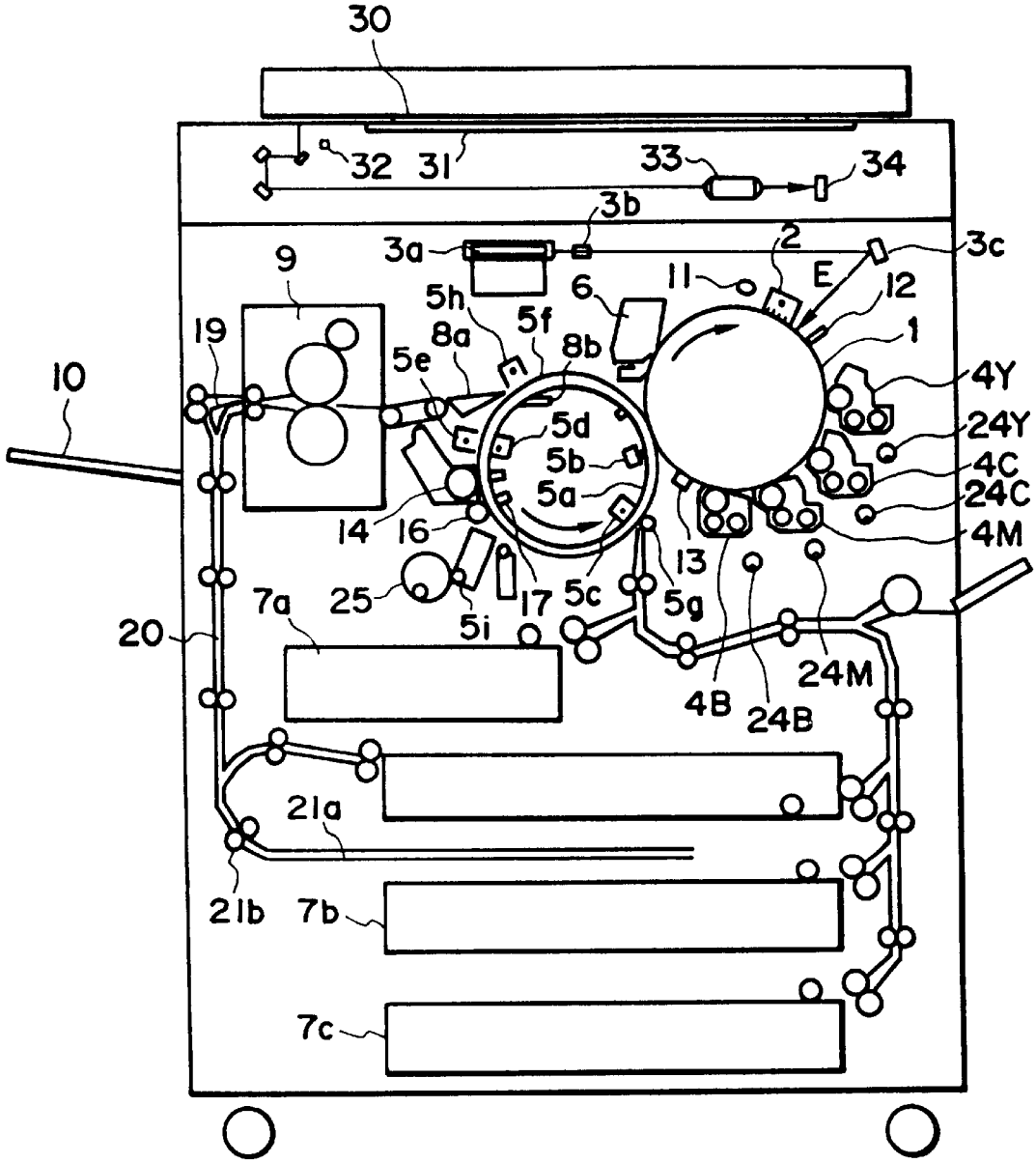
FIG. 1 is a schematic illustration of an example of full-color image forming apparatus to which the toner according to the present invention is applicable.

We have found it possible to provide a toner having a quick chargeability, having a high chargeability even in a high humidity environment and also being free from excessive charging even in a low humidity environment by using an organic zirconium compound (e.g., an organic zirconium complex or an organic zirconium salt) obtained by reaction of a zirconium compound with an aromatic diol, an aromatic monocarboxylic acid, an aromatic polycarboxylic acid or/and an aromatic hydroxycarboxylic acid. The organic zirconium compound used in the present invention is excellent in transparency and is desirably used in a color toner for providing clear color images. The organic zirconium compound can contain below 20 wt. % of hafnium element based on the zirconium element.

The organic zirconium compounds usable in the present invention may be classified into the following three categories:

(i) zirconium complexes each comprising metal element of zirconium and a ligand of an aromatic diol, an aromatic hydroxycarboxylic acid or an aromatic polycarboxylic acid, (ii) zirconium complex salts each comprising a metal element of zirconium and a ligand of an aromatic diol, an aromatic hydroxycarboxylic acid or an aromatic polycarboxylic acid, and (iii) salts of zirconium with aromatic carboxylic acids inclusive of aromatic carboxylic acids, aromatic hydroxycarboxylic acids and aromatic polycarboxylic acids.

It is preferred to use a zirconium complex or zirconium complex salt including 1–4 units of aromatic diol, aromatic hydroxycarboxylic acid or aromatic polycarboxylic acid so as to form a chelate. It is also possible to use a zirconium complex or complex salt including 1–6 units of coordinating carboxy anions of aromatic diol, aromatic hydroxycarboxylic acid or aromatic polycarboxylic acid.

In the case of an organic zirconium salt, it is preferred to use a salt having 1–4 units, more preferably 1–3 units, of aromatic carboxyl acid, aromatic hydroxycarboxylic acid or aromatic polycarboxylic acid. It is also possible to use a mixture of complexes or complex salts having different number of chelates or/and different species of ligands. The zirconium salt can also be a mixture of two or more species of organic zirconium salts including those of different numbers of acids per molecule.

The organic zirconium compound can also be a mixture of an organic zirconium complex compound and an organic zirconium salt.

It is preferred that the organic zirconium compound is used in combination with a resin having an acid value in order to further improve the triboelectric chargeability while utilizing the polarity of water molecules retained in the toner particles.

The toner according to the present invention containing the organic zirconium compound not only exhibits a sufficient chargeability in a low or high humidity environment but also suppresses a lowering in image density during a long term of continuous image formation.

The organic zirconium compound used in the present invention includes a zirconium ion capable of easily assuming an octa-coordinated configuration to be coordinated or bonded with oxygen of carboxyl and/or hydroxyl group. Accordingly, if a binder resin having an acid value, such as a styrene resin having a functional carboxyl group or a polyester resin, is used together therewith, the organic zirconium compound can exhibit a good affinity with and a good dispersibility in the binder resin, so that the liberation thereof from the toner particles can be well suppressed to provide a uniform and continuously stable chargeability. The organic zirconium compound exhibits little adverse effect to the toner transparency, thus being preferable for constituting a color toner.

Further, as the binder resin can be provided with an increased crosslinking via the carboxyl or hydroxyl group of the binder resin coordinated with the zirconium, the binder resin can be provided with an increased rubber elasticity, which favors an increased releasability and effective prevention of soiling of the fixing member. Thus, it is preferred that the binder resin is crosslinked to such a degree that it contains a THF-insoluble content. As a result, it becomes possible to exert a shearing force during melt-kneading, thus improving the dispersion of a pigment, or a dye to provide a toner exhibiting a high coloring power and/or a clear hue.

Now, the organic zirconium compounds inclusive of zirconium complex, complex salts and salt with aromatic diol, aromatic hydroxycarboxylic acid and aromatic polycarboxylic acid will be described more specifically.

Preferred examples of the zirconium complexes or complex salts may include those represented by formulae (1) and (2) below:

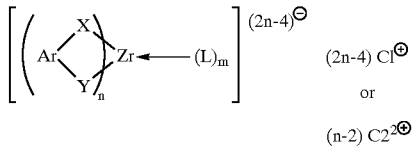

(1)

wherein Ar denotes an aromatic residual group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes —O— or —CO—O—; L denotes a neutral ligand of water, alcohol, ammonia, alkylamine or pyridine; C1 denotes a monovalent cation, such as hydrogen ion, monovalent metal ion, ammonium ion or alkylammonium ion; C2 denotes a divalent cation, such as a metal ion; n is 2,3 or 4; m is 0, 2 or 4; a number (n) of ligands (such as aromatic carboxylic acids and diols) can be identical to or different from each other, and a number (m>0) of neutral ligands can be identical to or different from each other in each complex or complex salt of a formula. Further, each complex or complex salt of a formula can also be a mixture of complex compounds having mutually different n or/and m, or a mixture of complex salts having mutually different counter ions C1 or/and C2. In order to improve the dispersibility in binder resin and charge control ability of a complex or complex salt, it is preferred that the aromatic residue group (Ar) comprises benzene ring, naphthalene ring, anthracene ring or phenanthrene ring; the optional substituent is alkyl, carboxyl or hydroxyl; L is water; and C1 is hydrogen, sodium, potassium, ammonium or alkylammonium.

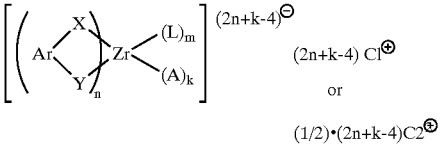

(2)

wherein Ar denotes an aromatic residue group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes —O— or —CO—O—; L denotes a neutral ligand of water, alcohol, ammonia, alkylamine or pyridine; A denotes an anion of halogen, hydroxyl, carboxylate, carbonate, nitrate, sulfate, cyano or thiocyano, a plurality of A can be identical or different when k≧2; C1 denotes a monovalent cation, such as hydrogen ion, monovalent metal ion, ammonium ion or alkylammonium ion; C2 denotes a divalent cation, such as a metal ion; n is 1,2,3 or 4; m is 0, 1, 2, 3 or 4; k is 1, 2, 3, 4, 5 or 6; a number (when n≧2) of ligands (such as aromatic carboxylic acids and diols) can be identical to or different from each other, and a number (when m≧2) of neutral ligands can be identical to or different from each other in each complex or complex salt of a formula. Further, each complex or complex salt of a formula can also be a mixture of complex compounds having mutually different n or/and m, or a mixture of complex salts having mutually different counter ions C1 or/and C2; and with the proviso that in case of A is a divalent anion, each k in the terms of (2n+k−4) is replaced by 2k, i.e., from (2n+k−4) to (2n+2k−4). In order to improve the dispersibility in binder resin and charge control ability of a complex or complex salt, it is preferred that the aromatic residue group (Ar) comprises benzene ring, naphthalene ring, anthracene ring or phenanthrene ring; the optional substituent is alkyl, carboxyl or hydroxyl; L is water; C1 is hydrogen, sodium, potassium, ammonium or alkylammonium; and A is hydroxyl or carboxylate ion.

Further, preferred sub-classes of zirconium complexes or complex salts may be represented by the following formulae (3)–(8).

(3)

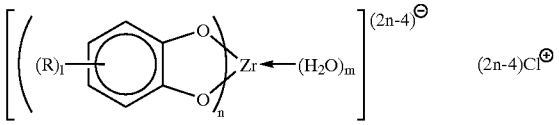

(4)

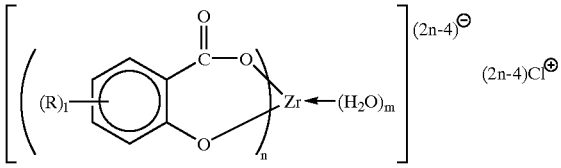

(5)

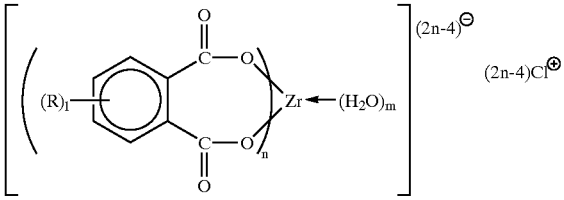

In the above formulae (3), (4) and (5), R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when $\underline{1} \geqq 2$) of R can be mutually linked to form an alicyclic, aromatic or heterocyclic ring capable of having 1–8 similar R substituent(s); a plurality of R can be identical or different; C1 denotes a monovalent cation such as hydrogen, alkaline metal, ammonium or alkylammonium; $\underline{1}$ is an integer of 1–8; n is 2, 3 or 4; m is 0, 2 or 4; a number (n) of ligands can be identical or different in each complex or complex salt of a formula. Further, each complex or complex salt of a formula can be a mixture of complex compounds having mutually different n or/and m, or a mixture of complex salts having mutually different counter ions C1. In order to improve the dispersibility in binder resin and charge control ability of the complex or complex salt, it is preferred that the substituent R is alkyl, alkenyl, carboxyl or hydroxyl; and C1 is hydrogen, sodium, potassium, ammonium or alkylammonium. It is particularly preferred to use a complex compound of the formula (4) or a neutral complex of the formula (3), (4) or (5) (wherein n=2) with no counter ion, so as to exhibit excellent environmental stability, dispersibility in the binder resin, and continuous image forming performances.

(6)

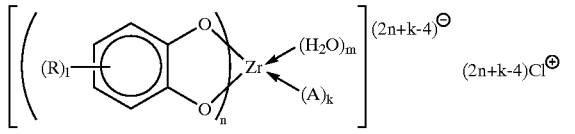

(7)

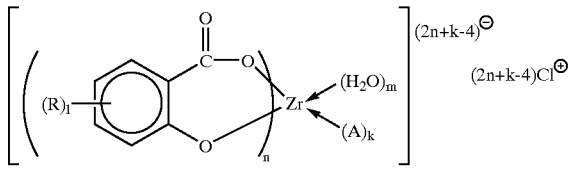

(8)

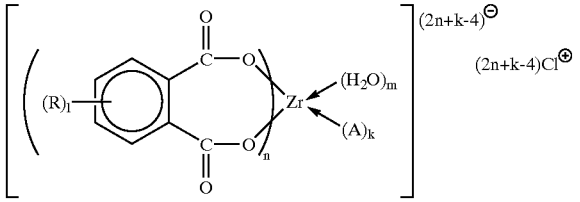

In the above formulae (6), (7) and (8), R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when $\underline{1} \geqq 2$) of R can be mutually linked to form an alicyclic, aromatic or heterocyclic ring capable of having 1–8 similar R substituent(s); a plurality of R can be identical or different; A denotes an anion of halogen, hydroxyl, carboxylate, carbonate, nitrate, sulfate, cyano or thiocyano, a plurality of A can be identical or different; C1 denotes a monovalent cation such as hydrogen, alkaline metal, ammonium or alkylammonium; $\underline{1}$ is an integer of 1–8; n is 1, 2, 3 or 4; m is 0, 2 or 4; k is 1, 2, 3, 4, 5 or 6; a number (when $n \geqq 2$) of ligands can be identical or different in each complex or complex salt of a formula. Further, each complex or complex salt of a formula can be a mixture of complex compounds having mutually different n or/and m, or a mixture of complex salts having mutually different counter ions C1 or/and anions A. In case where A is a divalent anion, each term (2n+k−4) is changed to (2n+2k−4). In order to improve the dispersibility in binder resin and charge control ability of the complex or complex salt, it is preferred that the substituent R is alkyl, alkenyl, carboxyl or hydroxyl; C1 is hydrogen, sodium, potassium, ammonium or alkylammonium and A is hydroxyl or carboxylate ion. It is particularly preferred to use a complex compound of the formula (7) or a neutral complex of the formula (6), (7) or (8) (wherein n=2) with no counter ion, so as to exhibit excellent environmental stability, dispersibility in the binder resin, and continuous image forming performances.

The zirconium complex or complex salt used in the present invention includes hexa-coordinated and octa-coordinated complex compound, and some octa-coordinated compound may assume a form of plural-nuclei complex compound wherein ligands form a crosslinkage to provide a rational formula giving a coordination number of 6. Further, it is also possible to form a plural-nuclei compound formed by successive linkage with ligands, such as hydroxyl groups.

Some typical example structures of such complex compounds are indicated by the following formulae (9)–(29), wherein some complex compounds having no ligand L are included.

(9)
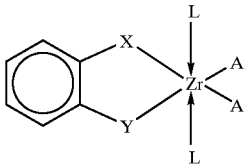
(10)
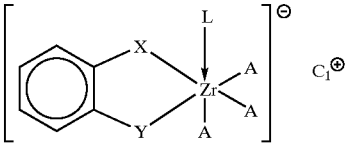
(11)
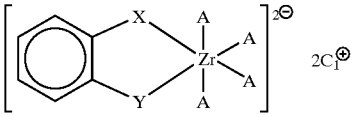
(12)
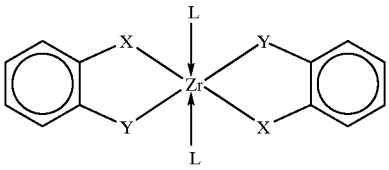
(13)
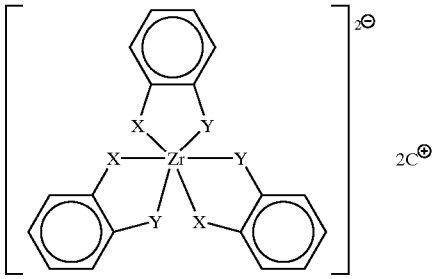
(14)
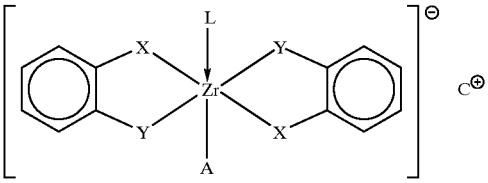
(15)
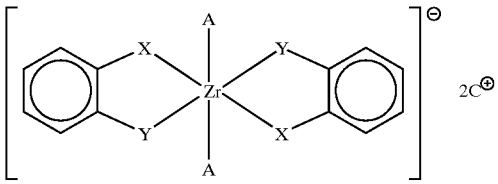
(16)
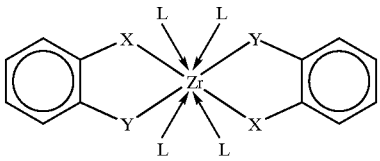
-continued
(17)
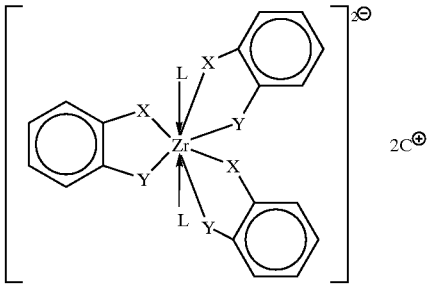
(18)
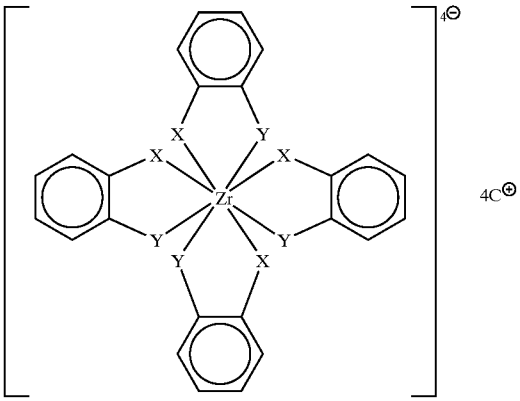
(19)
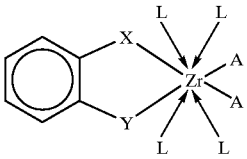
(20)
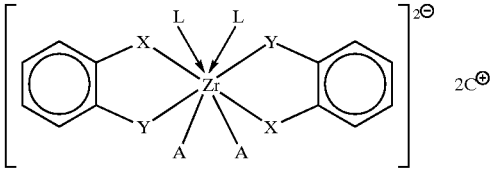
(21)
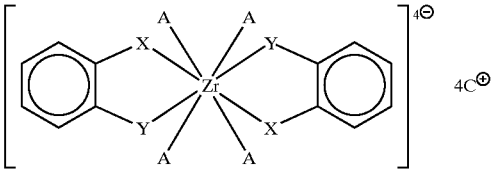
(22)
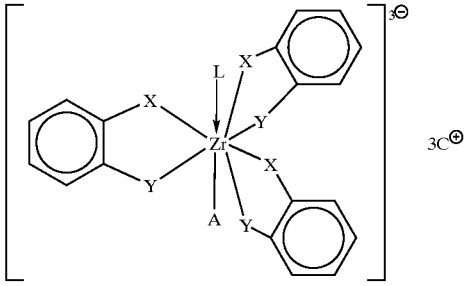

-continued (23)

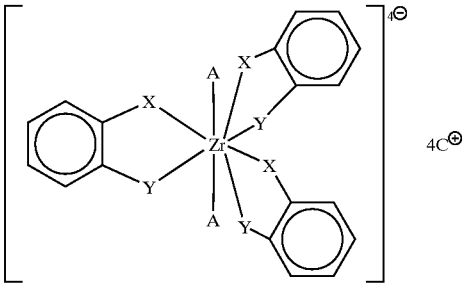

(24)

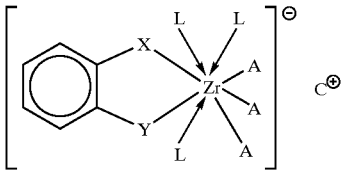

(25)

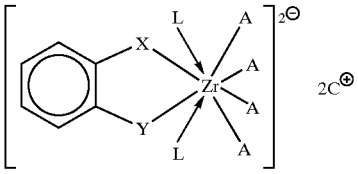

(26)

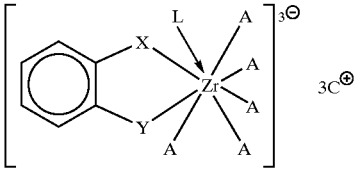

(27)

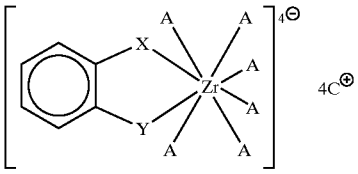

(28)

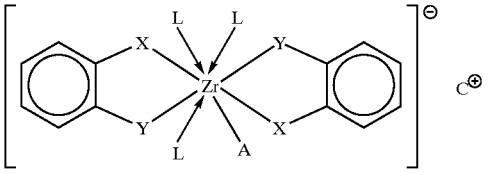

(29)

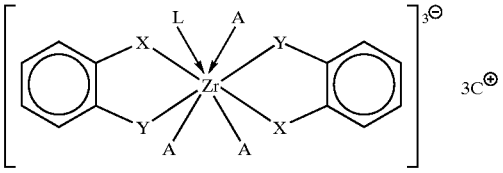

The organic zirconium compound used in the present invention can also assume a form of complex compound wherein a plurality of substituents, e.g., X and Y of hydroxyl and/or carboxyl, attached to an aromatic ring are bonded to different zirconium atoms as represented by a partial structural formula (30) below:

(30)

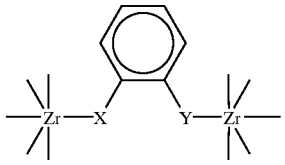

Such complex compounds may more generally be represented by the following formula (31):

(31)

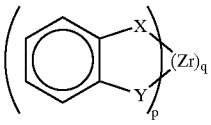

wherein p is an integer of at least 1 and q is an integer of at least 2. From the formula (31), anionic ligands, neutral ligands and counter-cations are omitted from showing.

Preferred classes of aromatic carboxylic acid zirconium salts as a category of the organic zirconium compound used in the present invention may include those represented by the following formulae (32) and (33):

$$(Ar—COO^-)_n Zr^{4\oplus}(4-n)A_1^{\ominus} \text{ or } (2-n/2)A_2^{2\ominus} \quad (32)$$

$$(Ar—COO^-)_n Zr^{4\oplus}(O)(2-n)A_1^{\ominus} \quad (33)$$

In the above formulae (32) and (33), Ar denotes an aromatic residue group capable of having a substituent of alkyl, aryl, aralkyl, cycloalkyl, alkenyl, alkoxy; aryloxy, hydroxyl, acyloxy, alkoxycarbonyl, aryloxycarbonyl, acyl, carboxyl, halogen, nitro, cyano, amino, amido or carbamoyl; $A_1$ denotes a monovalent anion such as halogen, hydroxyl, nitrate or carboxylate; $A_2$ denotes a divalent anion, such as sulfate, hydrogenphosphate or carbonate; and n is 1, 2, 3 or 4. In each formula, a plurality of acid ions, i.e., anions $A_1$, anions $A_2$, or acid ions of aromatic carboxylates or aromatic hydroxycarboxylates, may be identical or different. Further, each metal salt of a formula can be a mixture of different salts having different numbers of n. In order to improve the dispersibility in binder resin and chargeability of the zirconium salt, it is preferred that the aromatic residue group (Ar) comprises benzene ring, naphthalene ring, anthracene ring, or phenanthrene ring; the optional substituent is alkyl, carboxyl, hydroxyl or acyloxy.

Further, preferred sub-classes of the zirconium salt may be represented by the following formulae (34) and (35):

(34)

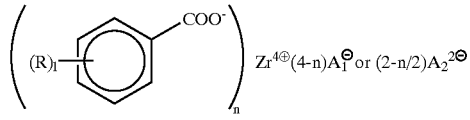

(35)

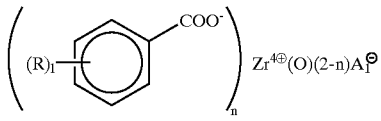

In the above formulae (34) and (35), each R denotes hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amide or carbamoyl; l is an integer of 1–8; a plurality.(when l≧2) of R can be mutually connected to form an alicyclic ring, aromatic ring or heterocyclic ring capable of having 1–8 substituents R that can be identical to or different from each other; $A_1$ denotes a monovalent anion, such as halogen, hydroxyl, nitrate or carboxylate; $A_2$ denotes a divalent anion, such as sulfate, hydrogenphosphate or carbonate; and n is 1, 2, 3 or 4 with the proviso that in each formula, a plurality of anions, i.e., anions $A_1$, anions $A_2$ or acid ions of aromatic carboxylic acids, may be identical or different. Further, each metal salt of a formula can be a mixture of different salts having different numbers of n. In order to improve the dispersibility in binder resin and chargeability of the zirconium salt, it is preferred that the optional substituent is alkyl, alkenyl, carboxyl, hydroxyl or acyloxy.

Further, preferred sub-classes of the zirconium salt may be represented by the following formulae (36) and (37):

(36)

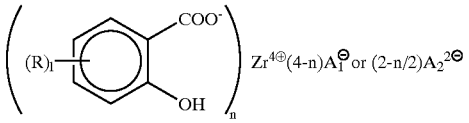

(37)

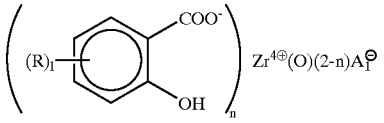

In the above formulae (36) and (37), each R denotes hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amide or carbamoyl; l is an integer of 1–7; a plurality (when l≧2) of R can be mutually connected to form an alicyclic ring, aromatic ring or heterocyclic ring capable of having 1–8 substituents R that can be identical to or different from each other; $A_1$ denotes a monovalent anion, such as halogen, hydroxyl, nitrate or carboxylate; $A_2$ denotes a divalent anion, such as sulfate, hydrogenphosphate or carbonate; and n is 1, 2, 3 or 4 with the proviso that in each formula, a plurality of anions, i.e., anions $A_1$, anions $A_2$ or acid ions of aromatic carboxylic acids, may be identical or different. Further, each metal salt of a formula can be a mixture of different salts having different numbers of n. In order to improve the dispersibility in binder resin and chargeability of the zirconium salt, it is preferred that the optional substituent is alkyl, alkenyl, carboxyl, hydroxyl or acyloxy.

The organic zirconium compound used in the present invention may be synthesized by dissolving a zirconium compound, such as zirconium chloride oxide, zirconium sulfate or an organic acid salt of zirconium in a solvent, such as water, alcohol or aqueous alcohol solution, and adding thereto (1) an aromatic carboxylic acid, an aromatic diol or an alkaline metal salt of these or (2) an aromatic carboxylic acid or an aromatic diol and an alkaline agent. The product organic zirconium compound may be purified by recrystallization from, e.g., an aqueous alcohol solution and washing with alcohol. Further, in the case of producing a complex salt, the above-prepared product may be treated with a mineral acid, an alkaline agent, an amine agent, etc., to prepare complex salts having various counter-ions. Thus, it is also possible to obtain an organic zirconium compound usable in the present invention which is a mixture of complex salts having a plurality of counter-ions selected from, e.g., hydrogen ion, alkaline metal ions and ammonium ion.

Hereinbelow, specific examples of the organic zirconium compound used in the present invention are enumerated with their rational formulae. Such organic zirconium compounds can include 2–4 water molecules as ligands but such water molecules are omitted from showing from the following examples. Further, such organic zirconium compound may include plural species of counter-ions but only a major counter-ion (largest in amount) is indicated in the following examples. In the following formulae, tBu- denotes a tertiary butyl group ($CH_3$—$C(CH_3)_2$—), Bu- denotes a normal-butyl group (n-$C_4H_9$—), MeO- denotes a methyloxy group ($CH_3O$—), Me- denotes a methyl group ($CH_3$—), and iPr- denotes an iso-propyl group ($(CH_3)_2CH$—).

(38)

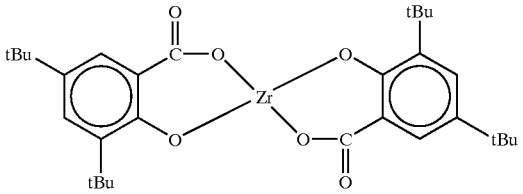

(39)

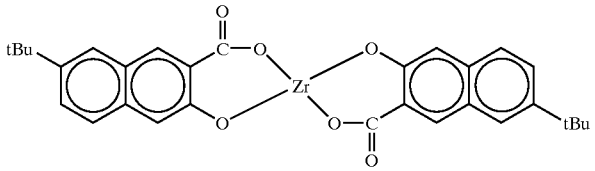

(40)

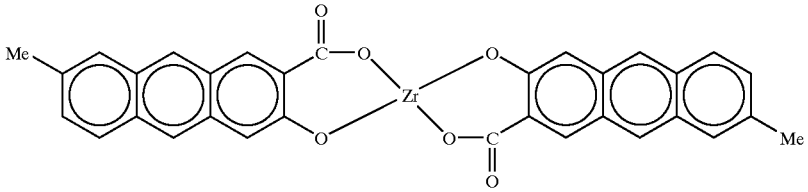

-continued
(41)
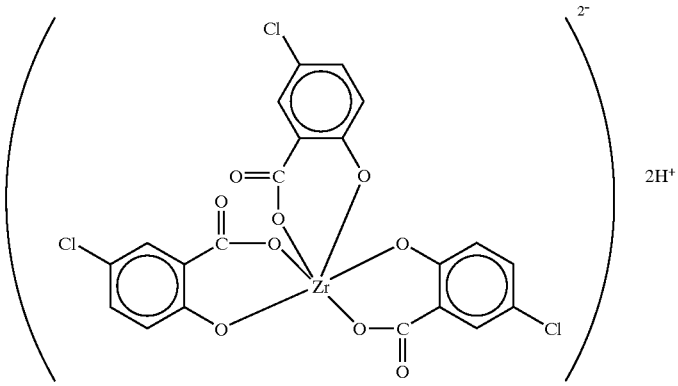
(42)
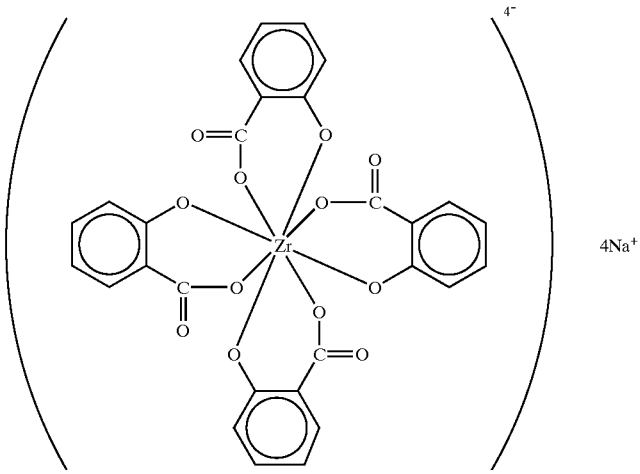
(43)
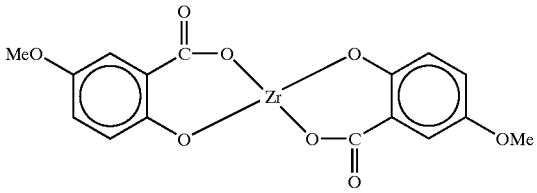
(44)
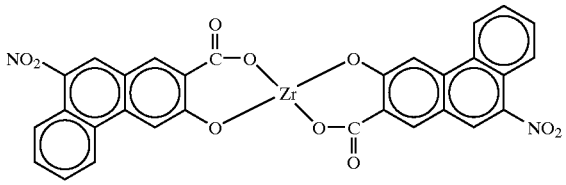
(45)
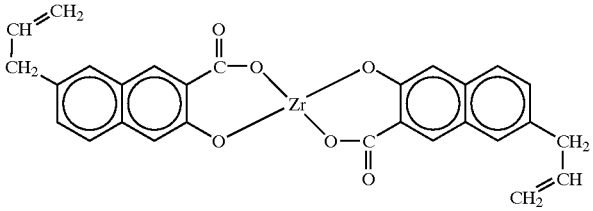
(46)
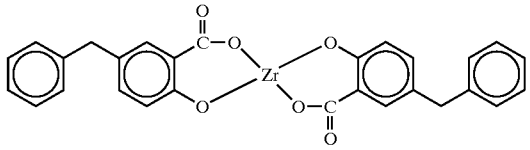
(47)
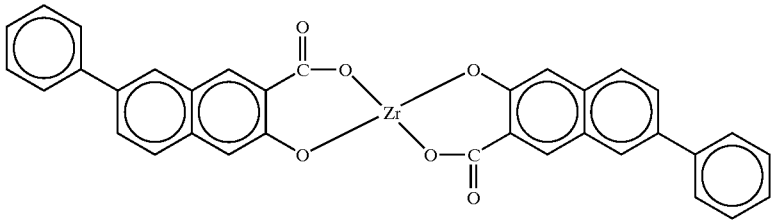

-continued
(48)
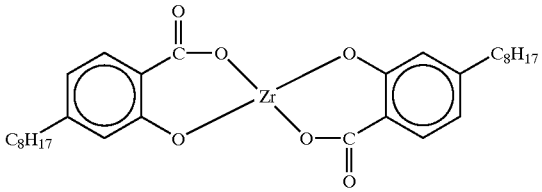
(49)
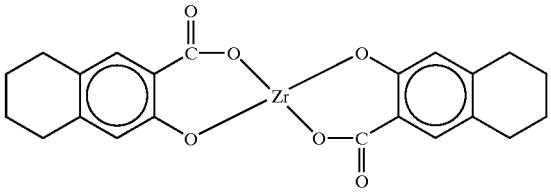
(50)
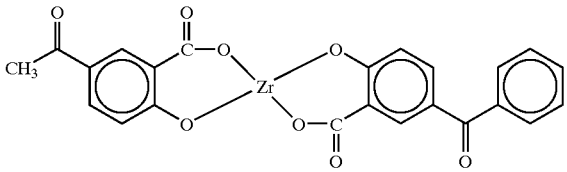
(51)
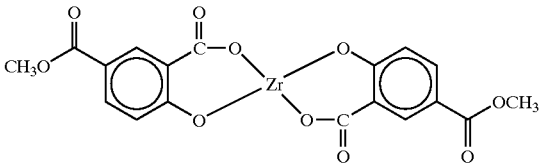
(52)
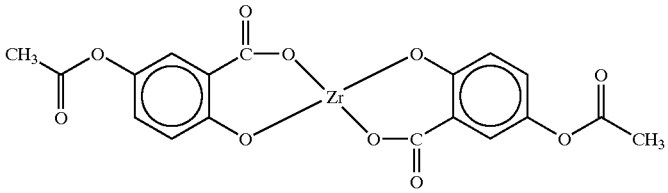
(53)
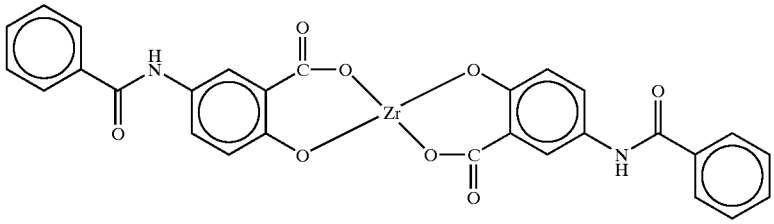
(54)
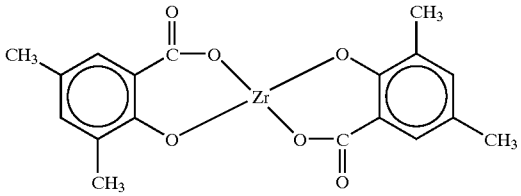
(55)
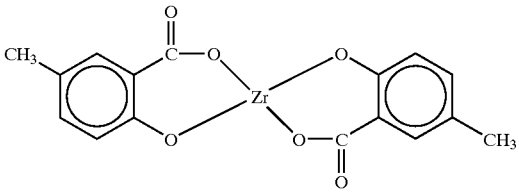
(56)
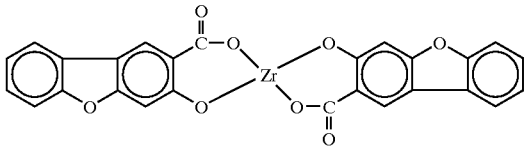
(57)
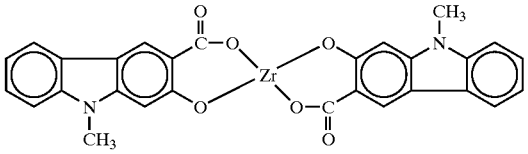
(58)
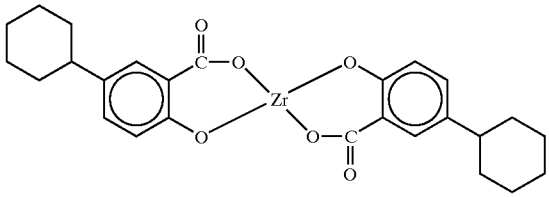
(59)
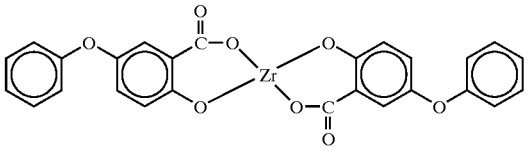

-continued
(60)
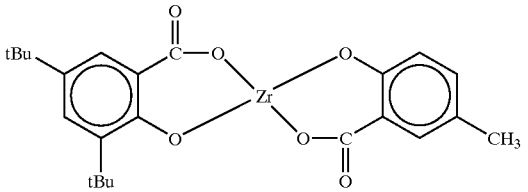
(61)
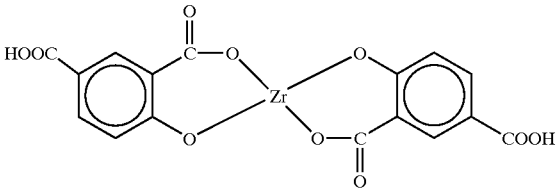
(62)
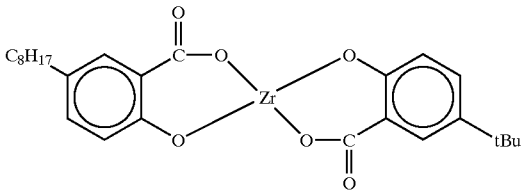
(63)
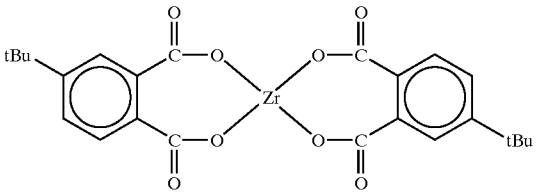
(64)
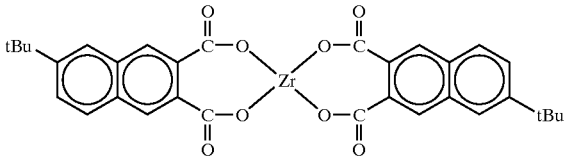
(65)
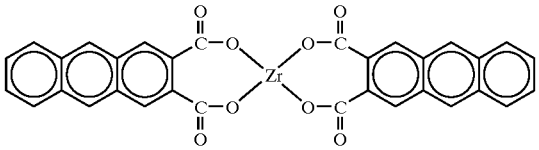
(66)
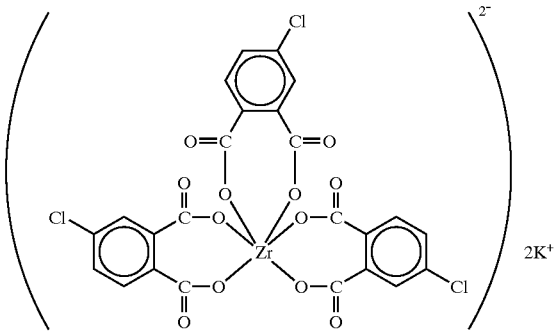
(67)
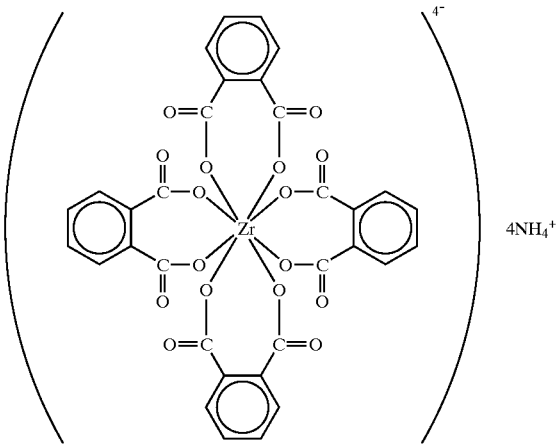
(68)
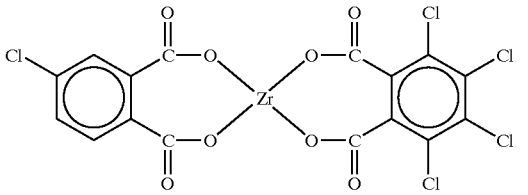
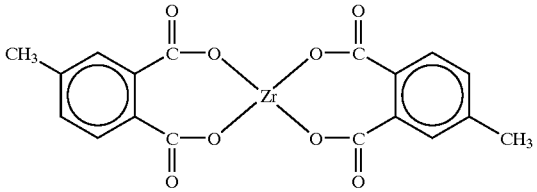
(69)
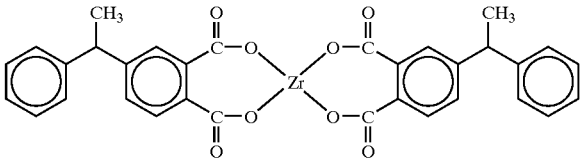
(70)

-continued
(71)
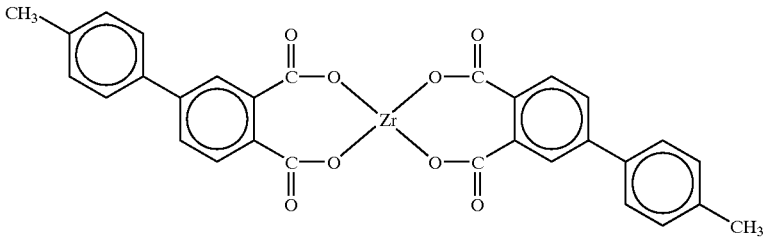
(72)
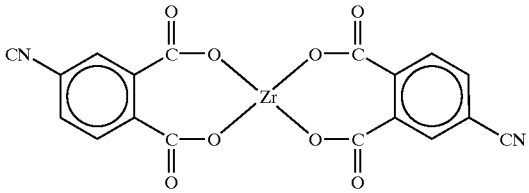
(73)
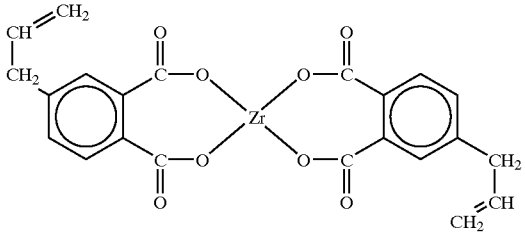
(74)
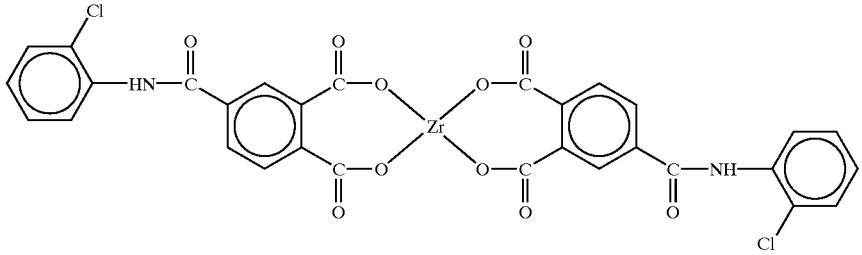
(75)
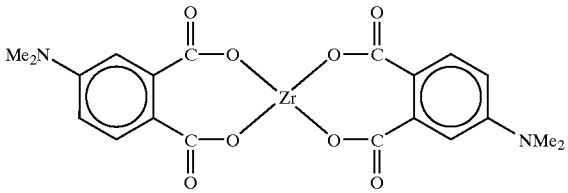
(76)
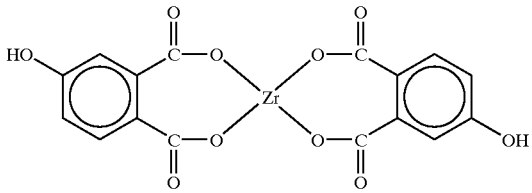
(77)
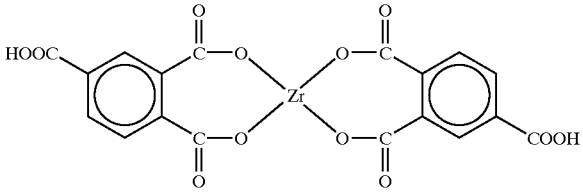
(78)
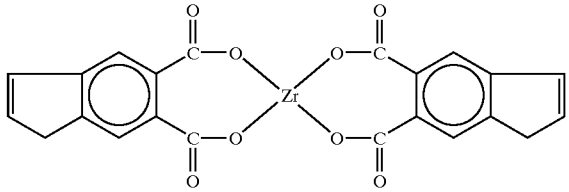
(79)
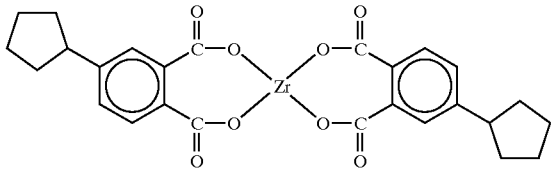
(80)
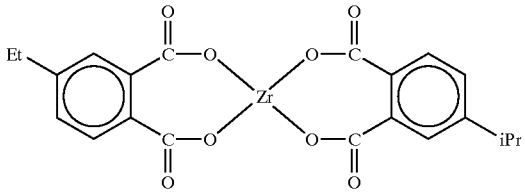
(81)
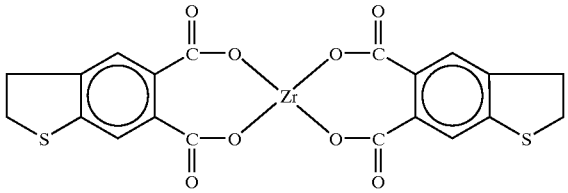
(82)
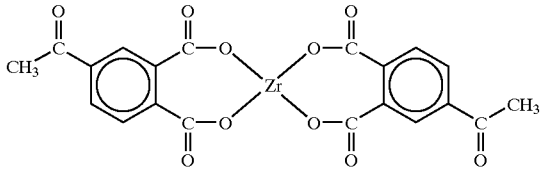

-continued
(83)
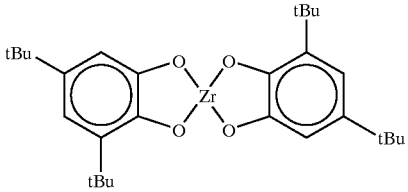
(84)
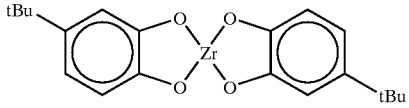
(85)
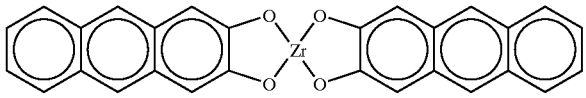
(86)
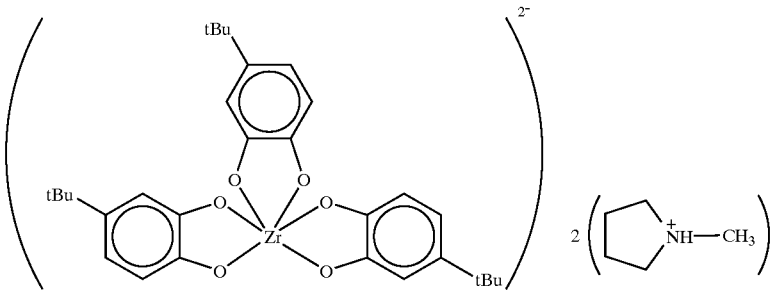
(87)
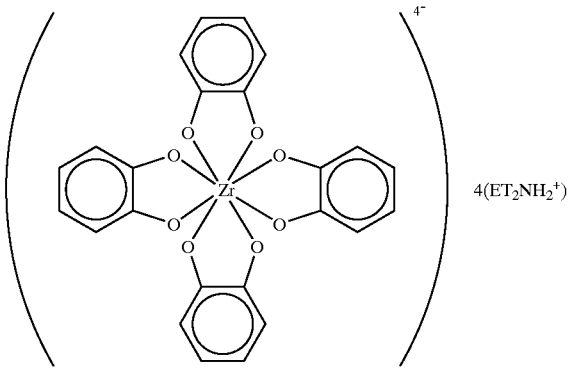
(88)
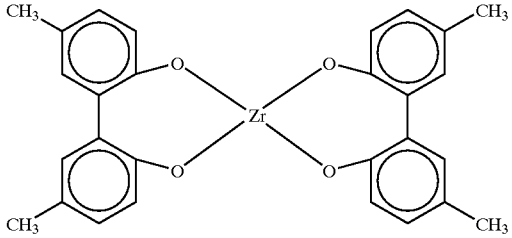
(89)
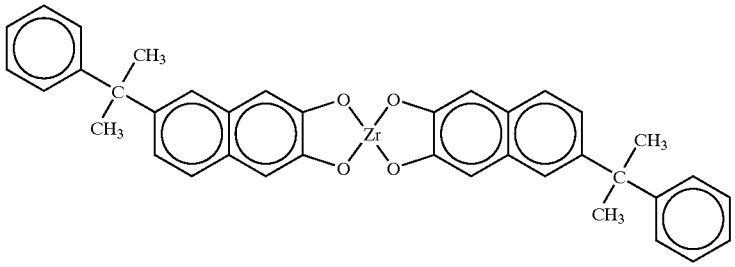
(90)
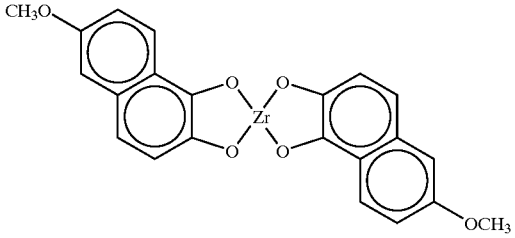
(91)
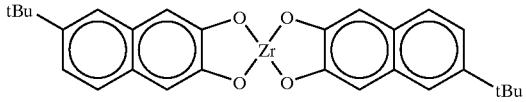

-continued
(92)
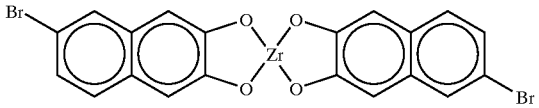
(93)
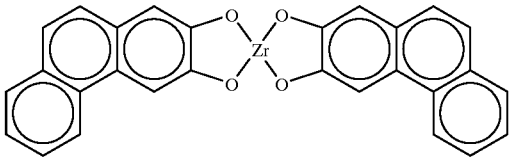
(94)
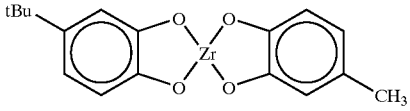
(95)
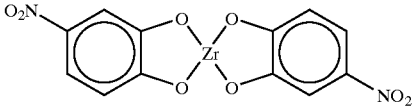
(96)
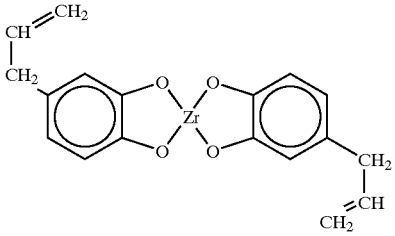
(97)
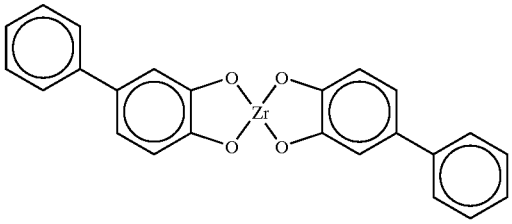
(98)
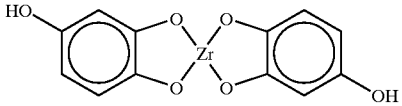
(99)
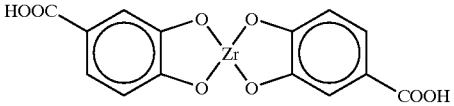
(100)
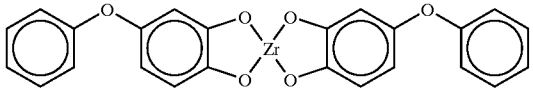
(101)
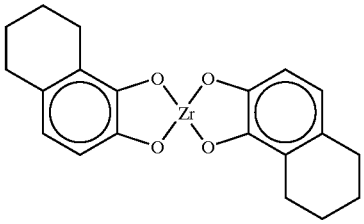
(102)
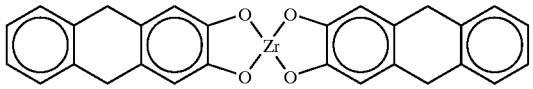
(103)
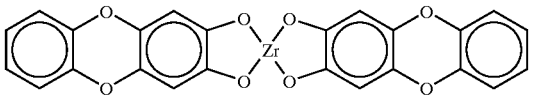
(104)
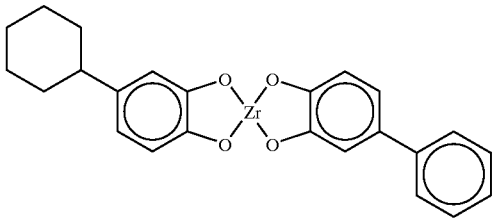
(105)
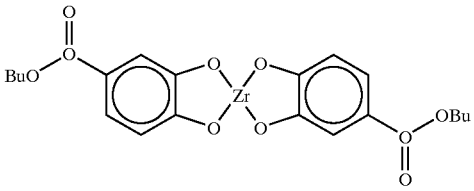
(106)
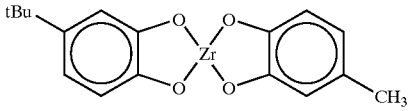
(107)
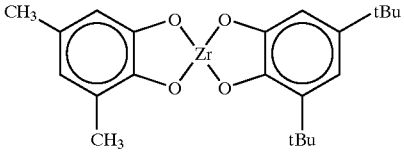
(108)
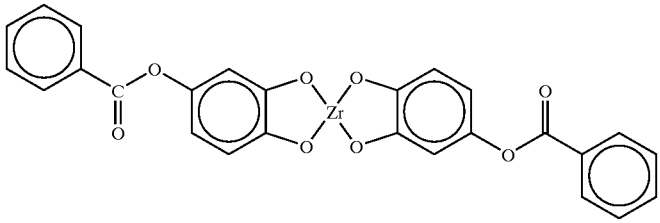

-continued
(109)
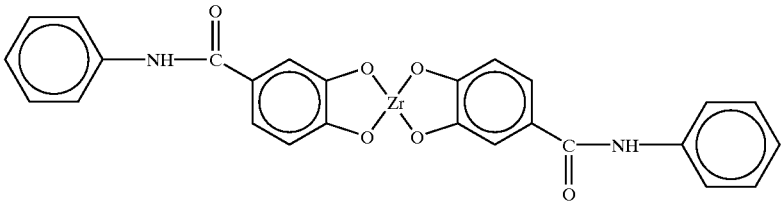
(110)
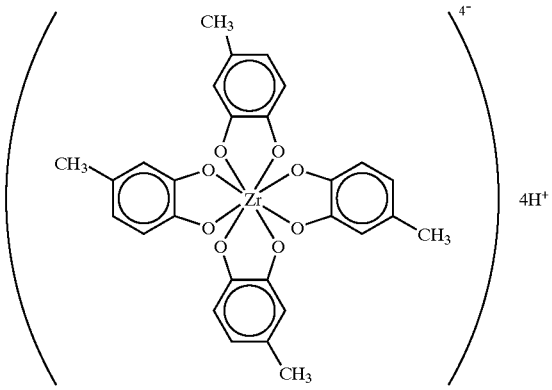
(111)
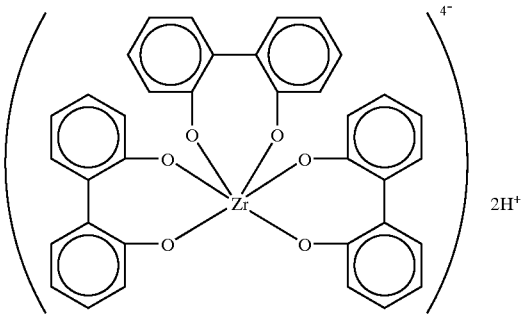
(112)
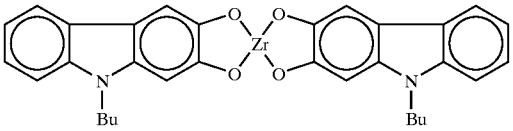
(113)
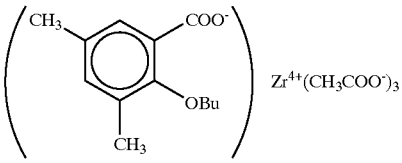
(114)
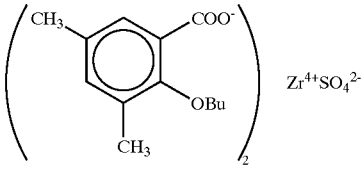
(115)
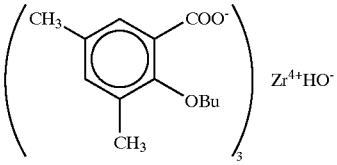
(116)
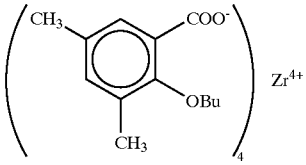
(117)
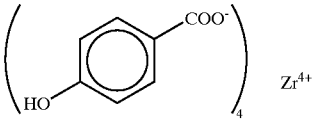
(118)
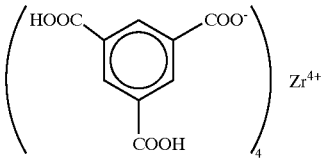
(119)
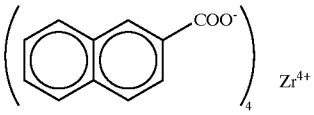
(120)
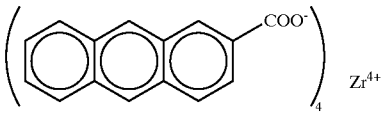
(121)
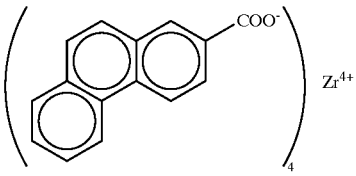

-continued
(122)
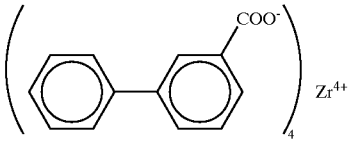
(123)
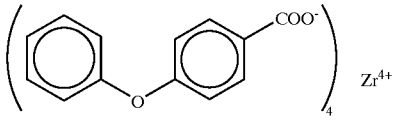
(124)
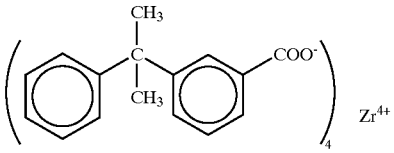
(125)
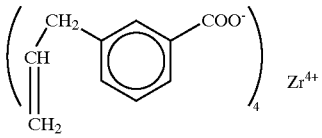
(126)
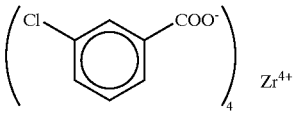
(127)
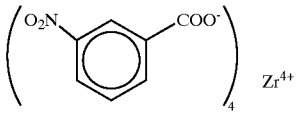
(128)
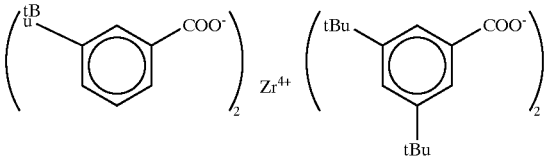
(129)
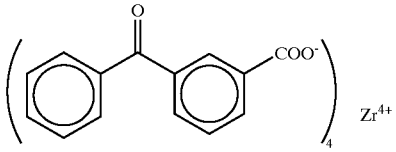
(130)
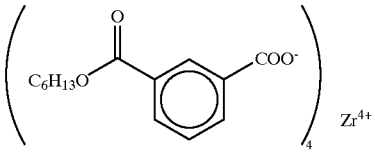
(131)
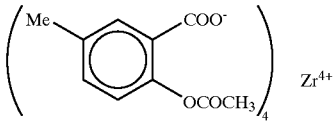
(132)
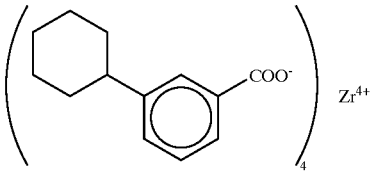
(133)
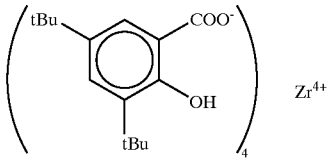
(134)
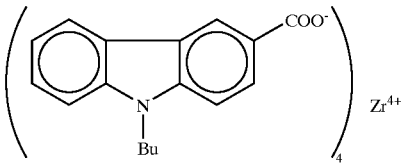
(135)
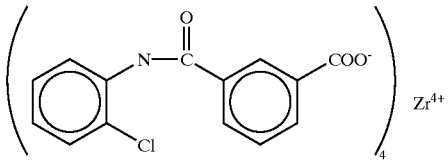
(136)
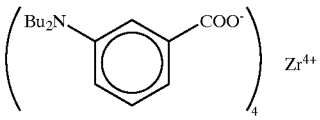
(137)
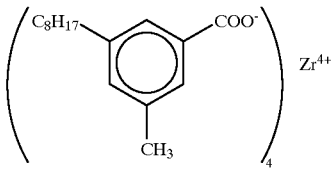
(138)
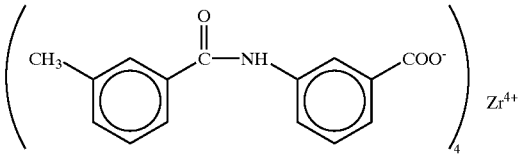
(139)
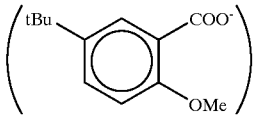

-continued
(140)
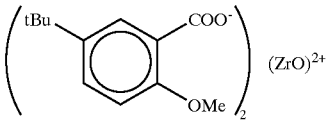
(141)
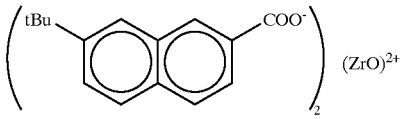
(142)
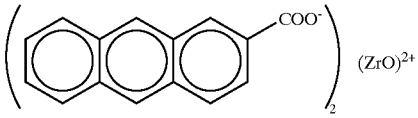
(143)
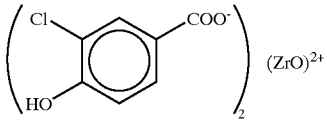
(144)
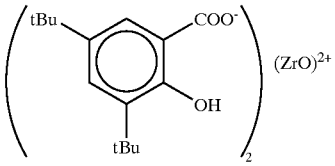
(145)
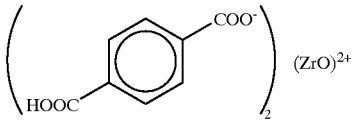
(146)
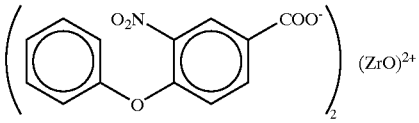
(147)
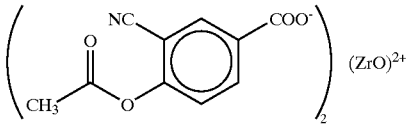
(148)
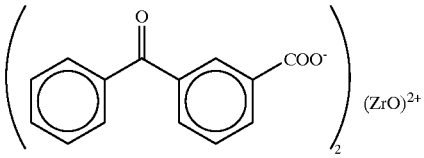
(149)
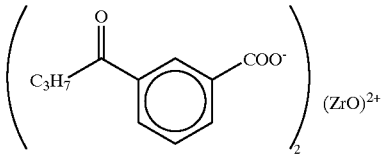
(150)
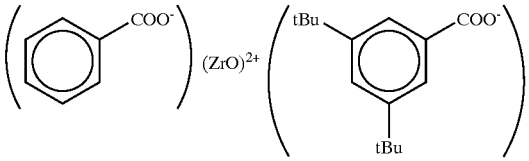
(151)
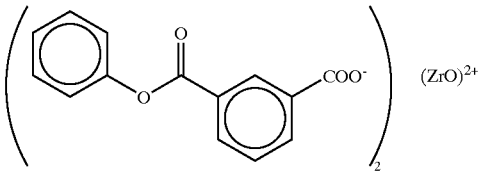
(152)
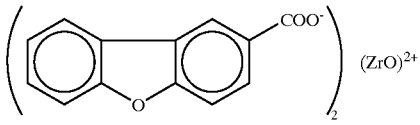
(153)
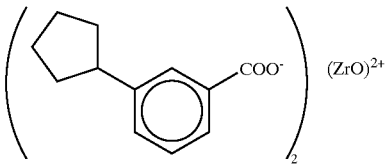
(154)
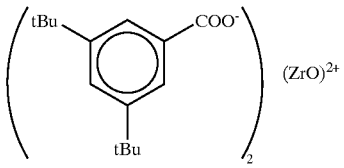
(155)
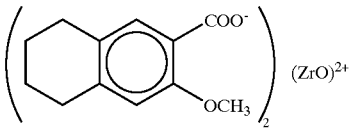
(156)
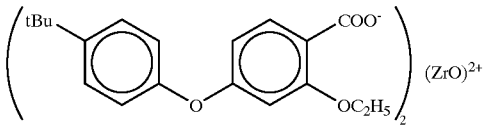

-continued
(157)
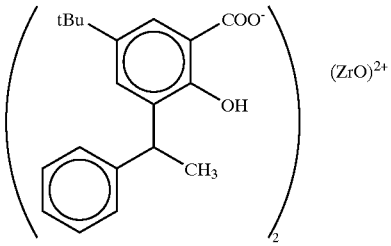
(158)
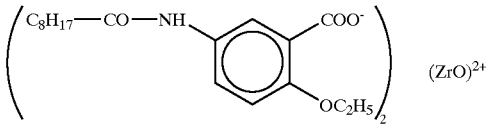
(159)
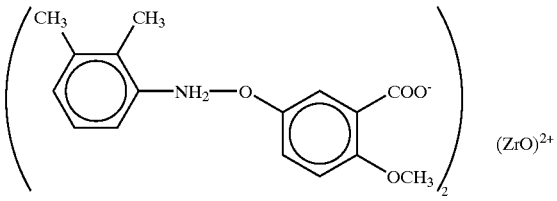
(160)
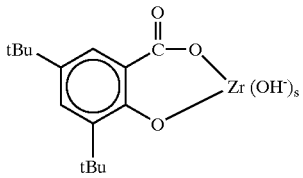
(161)
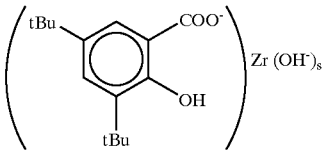
(162)
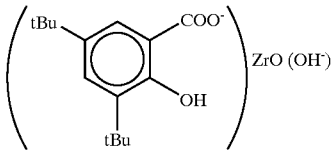
(163)
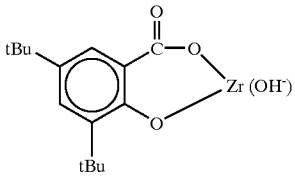
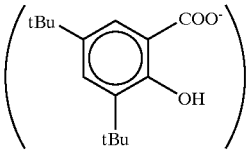
(164)
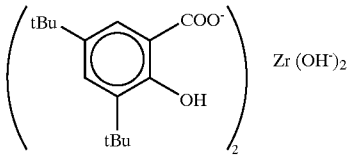
(165)
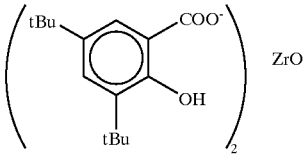
(166)
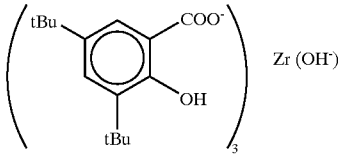
(167)
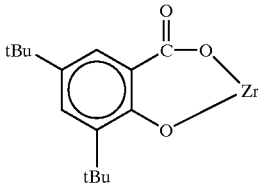
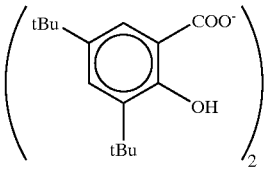
(168)
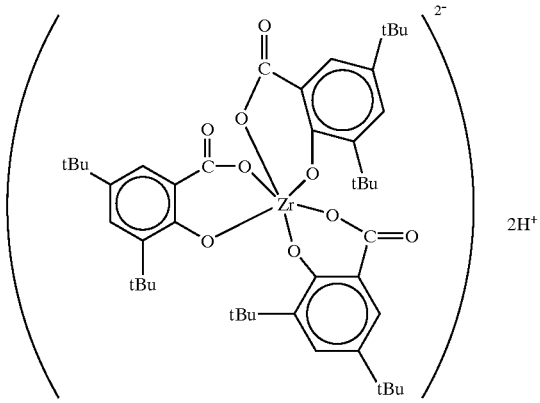

-continued (169)

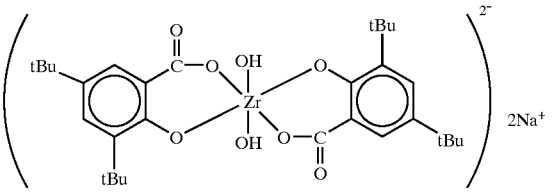

(170)

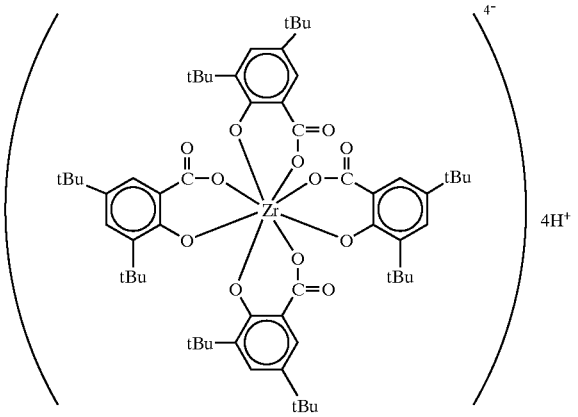

(171)

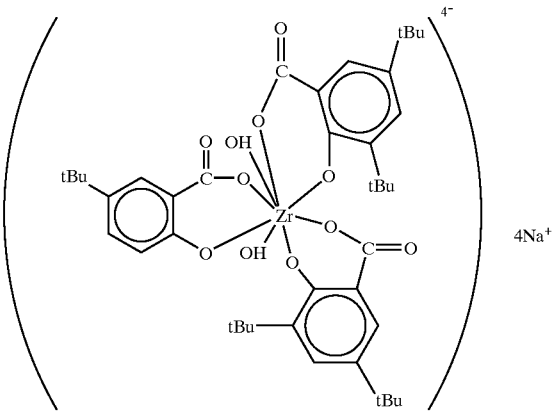

The organic zirconium compound used in the present invention may be incorporated in the toner by adding the organic zirconium compound internally into toner particles (i.e., as a component of toner particles) or externally to toner particles (i.e., as a powder blend with the toner particles). In the case of internal addition, the organic zirconium compound may preferably be added in 0.1–10 wt. parts, more preferably 0.5–5 wt. parts, per 100 wt. parts of the binder resin. In the case of external addition, the organic zirconium compound may preferably be added in 0.01–5 wt. pats per 100 wt. parts of the binder resin and it is particularly preferred that the organic zirconium compound is mechanochemically attached to the surface of toner particles. In the present invention, it is preferred that the organic zirconium compound is internally incorporated in the toner particles.

The organic zirconium compound can also be used in combination with a conventional charge control agent as described in the part of the related art herein, such as another organic metal complex, metal salt or chelate compound. Specific examples of such a known charge control agent may include: mono-azo metal complexes, acetylacetone metal complexes, hydroxy-carboxyic acid metal complexes, polycarboxylic acid metal complexes, and polyol metal complexes. Other examples may include: carboxylic acid derivatives, such as carboxylic acid metal salts, carboxylic acid anhydrides, and esters; and further, condensates of aromatic compounds, phenol derivatives, such as bisphenols and calix arenes.

Examples of the binder resin for constituting the toner according to the present invention may include: styrene resin, styrene copolymer resin, polyester resin, polyol resin, polyvinyl chloride resin, phenolic resin, natural resin-modified phenolic resin, natural resin-modified maleic acid resin, acrylic resin, methacrylic resin, polyvinyl acetate, silicone resin, polyurethane resin, polyamide resin, furan resins, epoxy resin, xylene resin, polyvinyl butyral, terpene resin, coumarone-indene resin, and petroleum resin.

In the present invention, it is preferred to use a polyester resin as a binder resin excellent in fixability and may suitably be used to provide a color toner. A polyester resin, however, shows a strong negative chargeability, and the use thereof is accompanied with several technical problems such that the resultant toner is liable to have an excessive chargeability and the chargeability thereof is liable to be lowered in a high temperature/high humidity environment. However, these problems can be solved by the use of the above-mentioned specific organic zirconium compound to provide an excellent color toner.

Examples of dihydric alcohols providing such a particle size may include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

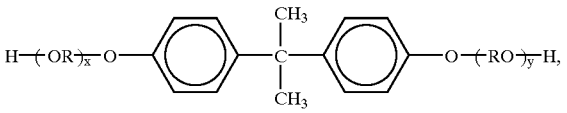

wherein R denotes an ethylene or propylene group, x and y are independently 0 or a positive integer with the proviso that the average of x+y is in the range of 0–10; and diols represented by the following formula (B):

(B)

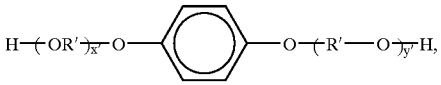

wherein R' denotes —$CH_2CH_2$—,

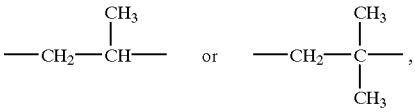

x' and y' are independently 0 or a positive integer with the proviso that the average of x'+y' is in the range of 0–10.

Examples of dibasic acids as another constituent of the polyester resin, may include dicarboxylic acids and derivatives thereof including:

benzenedicarboxylic acids, such as phthalic acid, terephthalic acid and isophthalic acid, and their anhydrides or lower alkyl esters; alkyldicarboxylic acids, such as succinic acid, adipic acid, sebacic acid and azelaic acid, and their anhydrides and lower alkyl esters; alkenyl- or alkylsuccinic acid, such as n-dodecenylsuccinic acid and n-dodecyl acid, and their anhydrides and lower alkyl esters; and unsaturated dicarboxylic acids, such as fumaric acid, maleic acid, citraconic acid and itaconic acid, and their anhydrides and lower alkyl esters.

The term "lower alkyl" used herein refers to an alkyl having up to 8 carbon atoms.

It is preferred to also use polyhydric alcohols having three or more functional groups and 1 or polybasic acids having three or more acid groups functioning as a crosslinking component in addition to the dihydric alcohol and the dibasic acids.

Examples of such polyhydric alcohol having three or more hydroxyl groups may include: sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of polybasic carboxylic acids having three or more functional groups may include polycarboxylic acids and derivatives thereof including: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, Empol trimer acid, and their anhydrides and lower alkyl esters; and tetracaboxylic acids represented by the formula (C):

(C)

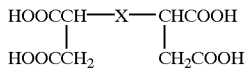

(X denotes a $C_1$ to $C_{30}$-alkylene group or alkenylene group having at least one side chain having at least one carbon atom), and their anhydrides and lower alkyl esters.

The polyester resin used in the present invention may preferably be constituted from 40–60 mol. %, more preferably 45–55 mol. %, of the alcohol component and 60–40 mol. %, more preferably 55–45 mol. %, of the acid component respectively based on the total of the alcohol and acid components. Further, the total of the polyhydric alcohol and the polybasic acid each having three or more functional groups may preferably constitutes 1–60 mol. % of the total alcohol and acid components constituting the polyester resin.

The polyester resin used in the present invention may be produced through a polycondensation process which per se is well known.

The polyester resin may have an acid value of 2.0–50.0 mgKOH/g, preferably 3.0–40.0 mgKOH/g, further preferably 5.0–30.0 mgKOH/g, so as to provide excellent chargeability in various environments.

In case where the polyester resin has an acid value less than 2.0 mgKOH/g, the resultant toner is liable to be excessively charged, thus resulting in lower image density in a low temperature/low humidity environment. Further, the dispersibility of the organic zirconium compound is liable to be lowered, thus resulting in a difference in chargeability among individual toner particles which leads to the occurrence of some fog in a long term of continuous image formation.

In case where the polyester resin has an acid value exceeding 50 mgKOH/g, the resultant toner is liable to have a lower stability of charge with time, thus being provided with a lower charge with the progress of a continuous image formation. Particularly, image defects, such as toner scattering and fog are liable to occur in a high temperature/high humidity environment.

Further, in view of the preservability, fixability and color-mixability with another color toner, the polyester resin may preferably have a glass transition temperature of 50–70° C., more preferably 52–68° C.

In case where the polyester resin has a glass transition temperature below 50° C., the resultant toner may have an excellent fixability but is caused to have a lower anti-offset property and is liable to cause soiling on the fixing roller and winding about the fixing roller. Further, the image quality of the resultant fixed toner image is liable to be lowered due to an excessively high surface gloss.

In case where the polyester resin has a glass transition temperature exceeding 70° C., the resultant toner is caused to have a lower fixability so that the set fixing temperature of the copying machine or printer has to be raised. Moreover, the resultant image is liable to have a lower gloss and exhibit a lower color mixability with another color toner when used in full-color image formation.

The polyester resin used in the present invention may preferably exhibit a molecular weight distribution as measured by gel permeation chromatography (GPC) providing a number-average molecular weight (Mn) of 1,500–50,000, more preferably 2,000–20,000, a weight-average molecular weight (Mw) of 6,000–100,000, more preferably 10,000–90,000, and an Mw/Mn ratio of 2–8. A polyester resin satisfying the above-mentioned molecular weight conditions may provide a good thermal fixability and an improved dispersibility of the colorant, thus providing a color toner suffering from little fractuation in chargeability to provide reliably good image quality.

In case where the polyester resin has an Mn below 1,500 or an Mw below 6,000, the resultant toner may provide fixed images having a high surface smoothness and a clear appearance, but is liable to cause offset in a continuous image formation on a large number of sheets. Further, the toner is liable to have a lower storage stability and cause toner sticking in the developing device and spent toner accumulation on the carrier surface. Further, it becomes difficult to apply a shearing force during melt-kneading of the toner materials for color toner particle production, thus resulting in a lower dispersibility of a chromatic colorant and a product color toner having a fluctuating triboelectric chargeability.

In case where the polyester resin has an Mn exceeding 50,000 or an Mw exceeding 100,000, the resultant color toner may have excellent anti-offset property but requires a high set fixing temperature. Further, even if the dispersibility of the colorant can be controlled, the toner is liable to provide a fixed image having a lower surface smoothness and exhibit a lower color reproducibility.

In case where the polyester resin has an Mw/Mn ratio below 2, the polyester resin is generally liable to have also a low molecular weight so that, similarly as in the above-mentioned case of a small molecular weight, the resultant toner is liable to cause difficulties, such as offset phenomenon during continuous image formation, a lowering in storage stability, occurrence of toner sticking and spent toner accumulation on the carrier in the developing device and fluctuation in toner charge.

In case where the polyester resin has an Mw/Mn ratio exceeding 8, the resultant toner may have an excellent anti-offset characteristic but requires an inevitably high fixing temperature and results in images having a lower surface smoothness and a lower color reproducibility even if the colorant dispersion can be adequately controlled.

The toner according to the present invention may preferably be composed as a color toner containing a colorant, particularly a chromatic colorant, which per se may be a conventional colorant known heretofore. A preferred full-color toner system exhibiting good chargeability, good toner flowability and good spectral reflection characteristics may be given by a combination of a cyan toner containing a copper phthalocyanine-based organic pigment, a magenta toner containing a quinacridone-based organic pigment, and a yellow toner containing a diarylide-based organic pigment.

Examples of the copper phthalocyanine-based organic pigment may include: C.I. Pigment Blue 15, 15:1, 15:2, 15:3 and 15:4, and further phthalocyanine pigments having a structure as represented by the following formula (a) including a phthalocyanine skeleton and 1–5 phthalimidomethyl groups as substituents attached to the skeleton. Copper phthalocyanine pigments having other substituents may also be used.

(a)

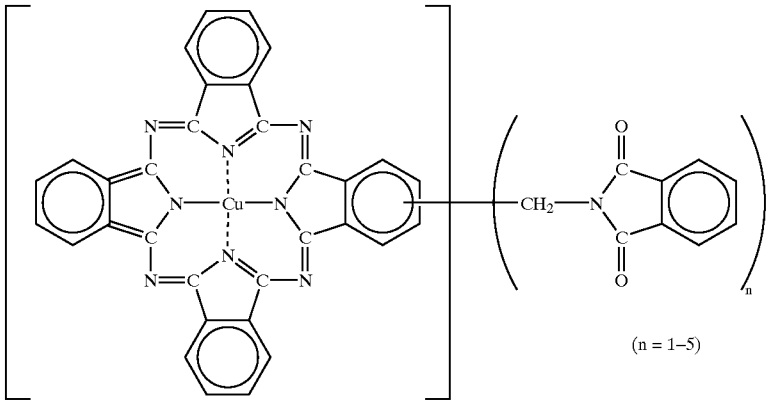

(n = 1–5)

The pigment may preferably be contained in 0.1–12 wt. parts, more preferably 0.5–10 wt. parts, further preferably 1–8 wt. parts, per 100 wt. parts of the binder resin. In excess of 12 wt. parts, the resultant cyan toner is caused to have lower saturation, brightness and color-reproducibility.

Preferred examples of the quinacridone-based organic pigment may include: C.I. Pigment Red 122; C.I. Pigment Red 192, 202, 206, 207, 209; and C.I. Pigment Violet 19. It is also possible to use another colorant in combination with C.I. Pigment Red 122 as the base pigment. Examples of such another colorant may include; pigments identified as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 123, 146, 150, 163, 184, 185, 238; C.I. Pigment Violet 19; and C.I. Vat Red 1, 2, 10, 13, 15, 23, 29, 35. It is also possible to use, as such another colorant, a dye as represented by xanthene dyes.

The quinacridone-based pigment may preferably be added in 0.1–15 wt. parts, more preferably 1–12 wt. parts, further preferably 1–10 wt. parts, per 100 wt. parts of the binder resin. Even in the case of co-use with another pigment or dye, such another pigment or dye should be at most 50 wt. parts, preferably at most 25 wt. parts, per 100 wt. parts of the quinacridone-based pigment.

Examples of the diarylide-based organic pigment may include: C.I. Pigment Yellow 12, 13, 14, 17, 81, 106, 113 as preferred examples; and further C.I. Pigment Yellow 55, 63, 87, 90, 114, 121, 124, 126, 127, 136, 152, 170, 171, 172, 174, 176, 188.

It is also possible to use C.I. Pigment Yellow 12, 13, 14, 17 or 81 as the base pigment together with another colorant, which can also be a yellow dye without any problem.

The pigment may preferably be contained in 0.1–12 wt. parts, more preferably 0.5–10 wt. parts, further preferably 1–8 wt. parts, per 100 wt. parts of the binder resin.

In the toner of the present invention, it is also possible to incorporate as a lubricant an aliphatic acid metal salt, such as zinc stearate, or aluminum stearate, or fine powder of a fluorine-containing polymer, such as polytetrafluoroethylene, polyvinylidene fluoride, or tetrafluoroethylene-vinylidene fluoride copolymer; or an electroconductivity-imparting agent, such as tin oxide or zinc oxide, as desired.

It is sometimes preferred to also incorporate a release agent as a fixing aid in the toner of the present invention. Examples thereof may include:

aliphatic hydrocarbon waxes and oxidized products thereof, waxes consisting principally of aliphatic acid esters, saturated linear aliphatic acids, unsaturated aliphatic acids, saturated alcohols, polyhydric alcohols, aliphatic acid amides, saturated aliphatic acid bisamides, unsaturated aliphatic acid amides, and aromatic bisamides. The release agent may be contained in 0.1–20 wt. parts, preferably 0.5–10 wt. parts, per 100 wt. parts of the binder resin. A release agent amount exceeding 20 wt. parts is liable to provide a toner with inferior anti-blocking characteristic or inferior anti-offset property. Below 0.1 wt. part, the release effect may be scarce.

The release agent may preferably be incorporated in the binder resin by a method of dissolving the resin in a solvent and adding the release agent into the resin solution under stirring at an elevated temperature, or by a method of mixing the release agent together with other toner-constituting materials at the time of kneading the binder resin to be incorporated into the binder resin.

The toner according to the present invention may for example be prepared by well melt-kneading the toner ingredients by means of a hot kneading machine, such as hot rollers, a kneader, or an extruder; and, after cooling for solidification of the kneaded product, subjecting the kneaded product to pulverization and strict classification, to provide toner particles having an objective particle size; or by a method of dispersing other toner ingredients such as a colorant in a binder resin solution and spray drying the resultant dispersion.

The toner according to the present invention may preferably have a weight-average particle size ($D_4$) of 3–15 μm, more preferably 4–12 μm. Below 3 μm, it becomes difficult to accomplish the chargeability stabilization, so that the toner is liable to provide foggy images and cause toner scattering in the image forming apparatus. Above 15 μm, the toner is liable to show a lower halftone reproducibility and result in rough. images.

The toner according to the present invention may preferably contain, as an external additive, a hydrophobized (i.e., hydrophobicity-imparted) inorganic fine powder having an average primary particle size of 0.001–0.2 μm and functioning as a flowability-improving agent. Examples of the (base) inorganic fine powder may include: fine powders of: metal oxides, such as silica, alumina, titanium oxide; magnesium oxide, and zinc oxide; nitrides, such as boron nitride, aluminum nitride and carbon nitride; and complex oxides, such as calcium titanate, strontium titanate, barium titanate, and magnesium titanate.

It is important for the inorganic fine powder not only to enhance the flowability of the toner but also not to hinder the chargeability of the toner. Accordingly, it is essential that the inorganic fine powder as an external additive has been hydrophobized (i.e., subjected a surface hydrophobicity-imparting treatment) so as to satisfy the flowability-improving effect and the charge stabilization effect in combination.

By hydrophobizing the inorganic fine powder, it becomes possible to remove the influence of moisture as a factor affecting the chargeability and reduce the chargeability difference between a high humidity environment and a low humidity environment, thereby improving the environmental stability of the toner. Further, during the hydrophobization step, it is possible to prevent the agglomeration of primary particles, thus providing a uniform charge-imparting effect.

In the present invention, it is particularly preferred to use hydrophobic titanium oxide fine powder or aluminum oxide fine powder having an average primary particle size of 0.001–0.2 μm because of good flowability and uniformization of negative chargeability of the toner, resulting in effective prevention of toner scattering and fog. Further, the flowability improving agent is not readily embedded at the toner particle surfaces, thus preventing toner deterioration and providing an improved continuous image forming performance on a large number of sheets. This tendency is particularly noticeable when used in a sharp-melting color toner.

Titanium oxide fine powder and alumina fine powder is preferred to silica fine powder because they have a substantially neutral chargeability while silica fine powder has a strong negative chargeability by itself and can be provided with an objective level of chargeability controllable based on a degree of hydrophobization.

The hydrophobizing agent used for this purpose may be appropriately selected depending the purpose of the treatment, such as chargeability control and charge-stabilization in a high humidity environment, and the reactivity. The hydrophobizing agent may for example comprise an organosilicon-type compound, examples of which may include: alkylalkoxysilanes, siloxanes, silanes and silicone oils. A compound free from thermal decomposition at the hydrophobization reaction temperature is preferred.

A particularly preferred class of hydrophobization agents may comprise alkylalkoxysilanes functioning as a coupling agent, having a volatility, having both a hydrophobic group and a reactive group and represented by the following formula: $R_mSiY_n$, wherein Y denotes a hydrocarbon group such as alkyl or vinyl, glycidoxy or methacryl; and m and n are respectively an integer of 1–3 satisfying m+n=4. Preferred examples of the alkylalkoxysilanes may include: vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltriethoxysilane, phenyltrimethoxysilane, n-hexadecyltrimethoxysilane, and n-octadecyltrimethoxysilane. A particularly preferred class of the alkylalkoxysilanes may be represented by the following formula:

$$C_aH_{2a+1}—Si—(OC_bH_{2b+1})_3,$$

wherein a denotes an integer of 4–12 and b denotes an integer of 1–3. If a is below 4, the hydrophobization treatment becomes easy but the resultant hydrophobicity is liable to be low. In case of a larger than 12, the resultant hydrophobicity is sufficient but the treated titanium oxide particles are liable to coalesce with each other to result in a lower flowability. A number b larger than 3 is liable to provide a lower reactivity and thus fail in hydrophobization. It is further preferred that a is 4–8 and b is 1–2.

The titanium oxide or alumina fine powder in 100 wt. parts may be treated with 1–50 wt. parts, preferably 3–45 wt. parts, of the hydrophobization agent so that the treated inorganic fine powder may have a hydrophobicity of 30–90%, preferably 40–80 %. If the hydrophobicity is below 30%, the resultant toner is liable to have a lower chargeability in a long period of standing in a high-humidity environment. If the hydrophobicity exceeds 90%, the charge control of the treated titanium oxide or alumina per se becomes difficult, thus being liable to cause a charge-up (excessive charge) of the toner in a low-humidity environment.

The hydrophobic titanium oxide or alumina fine powder may preferably have an average primary particle size of 0.001–0.2 $\mu$m, more preferably 0.005–0.1 $\mu$m. An average primary particle size exceeding 0.2 $\mu$m provides a lower flowability, whereby the toner chargeability is liable to be ununiform, thus resulting in toner scattering and fog. Below 0.001 $\mu$m, the powder is liable to be embedded at the toner particle surfaces, thus promoting the toner deterioration and lowering the continuous image forming performances. This liability is more pronounced in a color toner having a sharp melting characteristic. If the average primary particle size is below 0.001 $\mu$m, the activity of the inorganic fine powder per se inevitably becomes high and the particles thereof are liable to agglomerate with each other, thereby failing to provide an objective high flowability.

The titanium oxide or alumina fine powder may effectively be hydrophobized by a method wherein the inorganic fine powder is mechanically dispersed into primary particles in a liquid while simultaneously hydrolyzing the coupling agent, but this is not restrictive. Vapor phase treatment may also be applied without any problem.

The hydrophobized inorganic fine powder, such as the hydrophobized titanium oxide or alumina fine powder, may be added in 0.2–5.0 wt. parts, preferably 0.3–3.0 wt. parts, more preferably 0.2–2.5 wt. parts, to 100 wt. parts of the toner particles.

If the addition amount is less than 0.2 wt. part, the flowability-improving effect is liable to be insufficient, and in excess of 5 wt. parts, the inorganic fine powder is liable to be isolated from the toner particles. The isolated inorganic fine powder is liable to soil the carrier surface to lower the charge-imparting ability of the carrier per se. Further, the isolated inorganic fine powder is liable to be scattered on the surface of the photosensitive member, thus causing cleaning failure. Further, in the case of a color toner, excessive inorganic fine powder is liable to result in a shade in an OHP projected image, thus failing to provide a clear image.

The hydrophobized inorganic fine powder may preferably have a BET specific surface are ($S_{BET}$) of at least 100 $m^2/g$, more preferably at least 130 $m^2/g$.

If the BET specific surface area is smaller than 100 $m^2/g$, it is difficult to provide a high flowability. The decrease of BET specific surface area to below 100 $m^2/g$ from a sufficiently high BET specific surface area of inorganic fine powder before the hydrophobization treatment means a case where the inorganic fine powder not in a uniformly dispersed state but in an agglomerated state is reacted with the hydrophobizing agent or a case where the hydrophobizing agent is self-coagulated in an oil state to attach to the inorganic fine powder, and in either case, it is difficult to provide a uniformly surface-treated inorganic fine powder.

In addition to the above-described toner, the two-component developer according to the present invention includes a resin-coated carrier which is obtained by surface-coating a carrier core (or carrier core particles) with a coating material comprising at least a resin. The carrier core particles may comprise magnetic particles of, e.g., magnetic metals, such as surface-oxidized or -unoxidized iron, nickel, copper, zinc, cobalt, manganese, chromium and rare earth elements; magnetic alloys and magnetic oxides of these metals, and magnetic ferrites formed from these metals. Particularly preferred forms of carrier cores may comprise Cu—Zn—Fe-based ferrite principally comprising Cu, Zn and Fe, and Mn—Mg—Fe-based ferrite principally comprising Mn, Mg and Fe.

It is also possible to use a binder-type carrier core comprising carrier core particles wherein magnetic powder is dispersed in a resin binder.

The resin-coated carrier may be prepared by coating the carrier core with a solution or dispersion of a coating material comprising at least a resin, or by simple powder blending with powder of such a coating material.

The coating material attached onto the carrier core surface may for example comprise one or more species selected from polytetrafluoroethylene, monochlorotrifluoro-ethylene polymer, polyvinylidene fluoride, silicone resin, polyester resin, styrene-resin, acrylic resin, polyamides, polyvinylbutyral, and aminoacrylate resin.

Among such coating resins, it is preferred to use a styrene-methyl methacrylate copolymer, a mixture of a fluorine-containing resin and a styrene copolymer, or silicone resin. Silicone resin is particularly preferred because of stable ability of imparting a negative charge to a color toner in various environments and less liability of carrier soiling with the toner.

Examples of the mixture of a fluorine-containing resin and a styrene copolymer may include mixture of polyvinylidene fluoride and styrene-methyl methacrylate copolymer, a mixture of polytetrafluoroethylene and styrene-methylmethacrylate copolymer, a mixture of vinylidene fluoride-tetrafluoroethylene copolymer (copolymerization weight ratio (CP wt. ratio)=10–90:90–10) and styrene-2-ethylhexyl acrylate copolymer (CP wt. ratio= 20–80:80–20), and a mixture of vinylidene fluoride-tetrafluoroethylene copolymer (CP wt. ratio=10–90:90–10), and styrene-2-ethylhexyl acrylate-methyl methacrylate copolymer (CP wt. ratio=20–60:5–30:10–50).

The silicone resins may include: nitrogen-containing silicone resin and modified silicone resin formed by reaction of nitrogen-containing silane coupling agent with silicone resin.

The coating amount may be determined appropriately but may preferably be in a proportion of 0.01–5 wt. %, more preferably 0.1–1 wt. % of the resin-coated carrier.

The resin-coated carrier may preferably have a 50%-particle size (diameter at which the cumulative amount of the carrier particles reach 50% by volume from a smaller particle side or a larger paraticle side) of 20–70 $\mu$m.

If the 50%-particle size of the carrier is below 20 $\mu$m, the resultant two-component developer is excessively packed to a higher density, whereby the mixing of the toner and the carrier is reduced to make unstable the toner charge, and the carrier attachment onto the photosensitive member is liable to occur.

If the 50%-particle size exceeds 70 $\mu$m, the frequency of contact with the toner is lowered to result in a portion of toner having a lower charge, thus being liable to cause fog. Further, as the toner scattering is liable to occur, the toner concentration in the two-component developer has to be lowered, thus being liable to fail in providing high-density images.

As described above, since the toner according to the present invention contains a specific organic zirconium compound and includes hydrophobized inorganic fine powder, the toner can be provided with a high charge together with a quick chargeability even in a high humidity environment and also is free from excessive charge in a low humidity environment, so that it is particularly effectively combined with such a resin-coated carrier having a relatively small 50%-particle size of 20–70 μm.

More specifically, a resin-coated carrier having a relatively small 50%-particle size of at most 70 μm provides an increased frequency of contact with the toner and can uniformly charge individual toner particles but is liable to receive a larger stress in the developing apparatus, thus being liable to be gradually soiled with the toner during continuous image formation. Accordingly, such a small-particle size resin-coated carrier involves a peculiar problem attributable to its smallness of the particle size that the toner-charging ability is lowered and the resultant toner charge distribution is broadened to result in toner scattering and fog during a long term of continuous use. However, the toner containing a specific organic zirconium compound and including hydrophobized inorganic fine powder is substantially free from soiling with toner of the carrier, so that the resin-coated carrier can retain a high toner-charging ability and a quick charging ability comparable to those at the initial stage even in a long term of continuous use.

If the resin-coated magnetic carrier has a sharp particle size distribution as above, it can exhibit a preferable performance of triboelectrically charging the (color) toner according to the present invention and improved electrophotographic performances.

In order to provide a two-component developer with good electrophotographic performances, the toner according to the present invention may be blended with the carrier so as to provide a toner concentration in the developer of 2–15 wt. %, preferably 3–13 wt. %, more preferably 4–10 wt. %. If the toner concentration is below 2 wt. %, the image density is liable to be lowered and, in excess of 15 wt. %, the toner is liable to result in fog, cause scattering in the apparatus and lower the life of the developer.

Next, an example of process for forming full-color images according to electrophotography by using a two-component developer according to the present invention will be described with reference to FIG. 1.

More specifically, FIG. 1 is a schematic illustration of an image forming apparatus for forming a full-color image by electrophotography. The image forming apparatus shown in FIG. 1 is applicable as a full-color copying machine or a full-color printer.

In the case of using the apparatus as a full-color copying machine, as shown in FIG. 1, the copying apparatus includes a digital color image reader unit at an upper part and a digital color image printer unit at a lower part.

In the image reader unit, an original 30 is placed on a glass original support 31 and is subjected to scanning exposure with an exposure lamp 32. A reflection light image from the original 30 is concentrated at a full-color sensor 34 to obtain a color separation image signal, which is transmitted to an amplifying circuit (not shown) and is transmitted to and treated with a video-treating unit (not shown) to be outputted toward the digital image printer unit.

In the image printer unit, a photosensitive drum 1 as an electrostatic image-bearing member may, e.g., include a photosensitive layer comprising an organic photoconductor (OPC) and is supported rotatably in a direction of an arrow. Around the photosensitive drum 1, a pre-exposure lamp 11, a corona charger 2, a laser-exposure optical system (3*a*, 3*b*, 3*c*), a potential sensor 12, four developing apparatus containing developers different in color (4Y, 4C, 4M, 4B), a luminous energy (amount of light) detection means 13, a transfer device, and a cleaning device 6 are disposed.

In the laser exposure optical system, the image signal from the image reader unit is converted into a light signal for image scanning exposure at a laser output unit (not shown). The converted laser light (as the light signal) is reflected by a polygonal mirror 3*a* and projected onto the surface of the photosensitive drum via a lens 3*b* and a mirror 3*c*.

In the printer unit, during image formation, the photosensitive drum 1 is rotated in the direction of the arrow and charge-removed by the pre-exposure lamp 11. Thereafter, the photosensitive drum 1 is negatively charged uniformly by the charger 2 and exposed to imagewise light E for each separated color, thus forming an electrostatic latent image on the photosensitive drum 1.

Then, the electrostatic latent image on the photosensitive drum is developed with a prescribed toner by operating the prescribed developing deice to form a toner image on the photosensitive drum 1. Each of the developing apparatus 4Y, 4C, 4M and 4B performs development by the action of each of eccentric cams 24Y, 24C, 24M and 24B so as to selectively approach the photosensitive drum 1 depending on the corresponding separated color.

The transfer device includes a transfer drum 5*a*, a transfer charger 5*b*, an adsorption charger 5*c* for electrostatically adsorbing a transfer(-receiving) material, such as transfer paper or an OHP sheet, an adsorption roller 5*g* opposite to the adsorption charger 5*c* an inner charger 5*d*, an outer charger 5*e*, and a separation charger 5*h*. The transfer drum 5*a* is rotatably supported by a shaft and has a peripheral surface including an opening region at which a transfer sheet 5*f* as a recording material-carrying member for carrying the recording material is integrally adjusted. The transfer sheet 5*f* may include a resin film, such as a polycarbonate film.

A recording material is conveyed from any one of cassettes 7*a*, 7*b* and 7*c* to the transfer drum 5*a* via a recording material-conveying system, and is held on the transfer drum 5*a*. The recording material carried on the transfer drum 5*a* is repeatedly conveyed to a transfer position opposite to the photosensitive drum 1 in accordance with the rotation of the transfer drum 5*a*. The toner image on the photosensitive drum 1 is transferred onto the recording material by the action of the transfer charger 5*b* at the transfer position.

The toner image may be directly transferred to the recording material without via an intermediate transfer member as shown in FIG. 1. Alternatively, the toner image may be once transferred to an intermediate transfer member (primary transfer) and then retransferred from the intermediate transfer member to the recording material (secondary transfer).

The above image formation steps are repeated with respect to yellow (Y), magenta (M), cyan (C) and black (B) to form a color image comprising superposed four color toner images on the recording material carried on the transfer drum 5*a*.

The recording material thus subjected to transfer of the toner image (including four color images) is separated from the transfer drum 5*a* by the action of a separation claw 8*a*, a separation and pressing roller 8*b* and the separation charger 5*h* to be conveyed to heat and pressure-fixation device 9, at which the toner image on the recording material is fixed under heating and pressure to effect color-mixing and color development of the toner and fixation of the toner onto the recording material to form a full-color fixed image (fixed full-color image), followed by discharge thereof into a tray 10. As described above, a full-color copying operation for one sheet of recording material is completed. On the other hand, a residual toner on the surface of the photosensitive drum 1 is cleaned and removed by the cleaning device 6, and thereafter the photosensitive drum 1 is again subjected to next image formation. The cleaning member may be a fur brush or unwoven cloth instead of a blade, or can be a combination of these.

With respect to the transfer drum 5*a*, an electrode roller 14 and a fur brush 15 are oppositely disposed via the transfer sheet 5*f*, and an oil-removing roller 16 and a backup brush 17 are also oppositely disposed via the transfer sheet. By using these members, powder and/or oil attached to the transfer sheet 5*f* is cleaned and removed. This cleaning operation is performed before or after image formation. After an occurrence of jam phenomenon (paper jamming or plugging), the cleaning operation may be effected, as desired.

An eccentric cam 25 is operated at a desired timing to actuate a cam follower 5 integrally supported to the transfer drum, whereby a gap (spacing) between the transfer sheet 5*f* and the photosensitive drum can be arbitrarily set. For instance, at the time of stand-by or shut-off of power supply, the gap between the transfer drum 5*a* and the photosensitive drum 1 can be made larger.

A full-color fixed image is thus formed by the above image forming apparatus. In the above apparatus, image formation may appropriately be performed in a single color mode or a full color mode to provide a single color fixed image or a full color fixed image, respectively.

The organization of a developing apparatus 4 (4Y, 4C, 4M and 4B) in the image forming apparatus of FIG. 1 is described in further detail with reference to FIG. 2.

Figure 2:
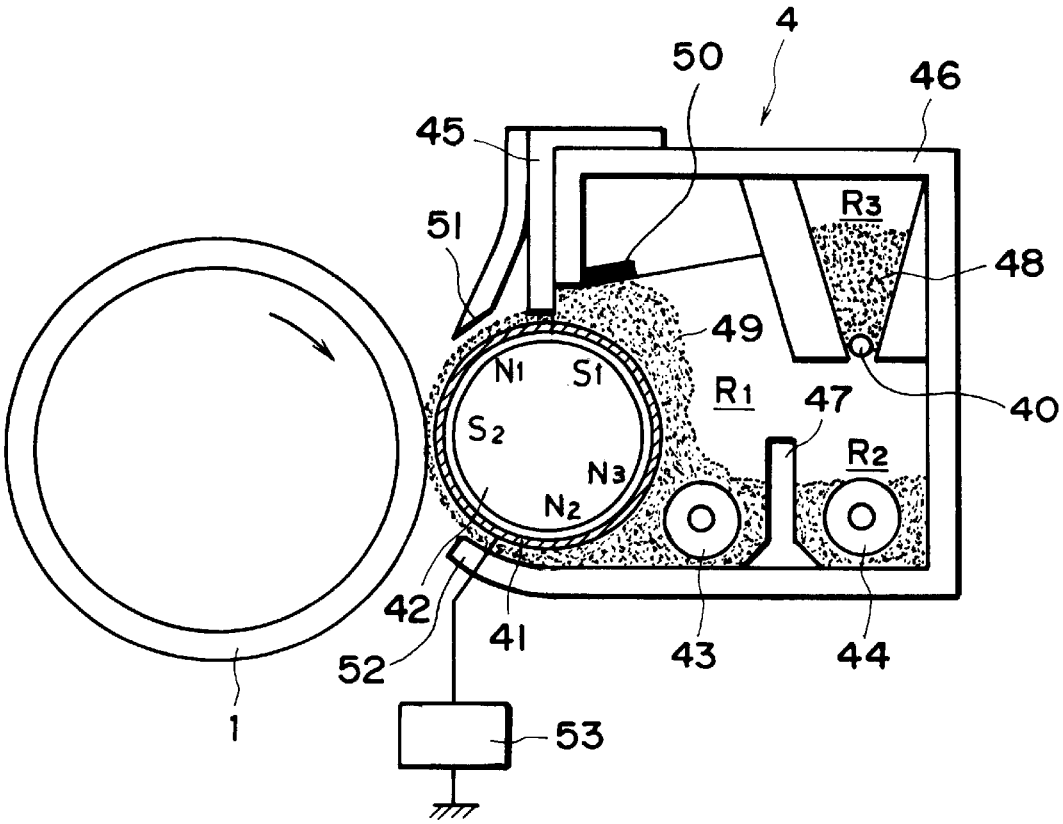
FIG. 2 is an enlarged illustration of a developing apparatus included in the image forming apparatus of FIG. 1.

Referring to FIG. 2, a developing apparatus includes a developer vessel 46, which is divided into a developing chamber (first chamber) R1 and a stirring chamber (second chamber) R2 by a partitioning wall 47. Above the stirring chamber R2, a toner storage chamber R3 is defined. In the developing chamber R1 and the stirring chamber R2, a two-component developer 49 comprising a non-magnetic toner and a magnetic carrier is contained. A replenishing toner (non-magnetic toner) 48 is stored in the toner storage chamber R3 and is supplied therefrom at a rate corresponding to the consumed amount of the toner from the developing chamber R1 by dropping through a replenishing port 40 disposed at the bottom of the chamber R3 into the stirring chamber R2. The replenishment of the toner 48 into the stirring chamber R2 is performed when the toner concentration of the two-component developer 49 in the developing chamber R1 is lowered to a prescribed level as detected by an ATR photo-detector member 50, which is disposed at a position contacting the developer 49 in the developing chamber R1 and has a contacting surface provided with a detection window composed of a transparent material so as to illuminate the developer and measure a reflected light quantity from the developer 49.

In the developing chamber R1, a conveying screw 43 is disposed so as to convey the developer 49 in a longitudinal direction of a developing sleeve 41 by a rotation thereof. In the stirring chamber R2, a conveying screw 44 is similarly disposed so as to convey the replenishing toner 48 supplied to the stirring chamber R2 by dropping through the replenishing port 40 in the longitudinal direction of the developing sleeve 41 by a rotation thereof.

The developer vessel 46 is provided with an opening at a part close to a photosensitive drum 1, and a portion of the developing sleeve 41 protrudes out of the opening toward the outside so as to leave a gap between the developing sleeve 41 and the photosensitive drum 1. The developing sleeve 41 is composed of a non-magnetic material and is connected to a developing bias application means 53, so as to be supplied therefrom with a developing bias voltage at the time of development of an electrostatic image on the photosensitive drum 1 with the developer 49.

The bias voltage may comprise a DC voltage or a DC voltage superposed with an AC voltage. A DC voltage superposed with an AC voltage is however preferred so as to provide an enhanced dot uniformity of a halftone image. It is particularly preferred that the AC voltage has an intermittent or. blank-pulse waveform including a pulse portion and a blank portion alternately so as to provide an enhanced dot uniformity of a halftone image, provide an enhanced developing performance and suppress the carrier attachment.

In the case of applying such an AC-superposed DC voltage as a bias voltage, a delicate vibration is applied to a magnetic brush composed of a two-component developer, so that the carrier surface is liable to be soiled with the toner during continuous image formation on a large number of sheets. In the present invention, however, the toner soiling on the carrier surface does not substantially occur during continuous image formation owing to the use of a specific organic zirconium compound, thus being able to exhibit a good developing performance even after a continuous image formation on a large number of sheets.

The developing bias voltage may preferably comprise a DC voltage (component) of 100–1200 volts, more preferably 200–1000 volts, preferably superposed with a blank-pulse AC voltage component with a frequency of 500–24000 Hz, preferably 1000–20000 Hz, and a peak-to-peak voltage (Vpp) of 500–3000 volts, preferably 800–2500 volts, in the AC portion including each AC unit comprising a prescribed number (e.g., 1 to 10) of waves intervened or followed by a blank period.

A magnet roller 42 as a magnetic field application means is fixedly housed within the developing sleeve 41 and includes a developing pole $S_2$, a pole $N_2$ disposed downstream of $S_2$, and poles $N_3$, $S_1$ and $N_1$ for conveying the developer 49. The developing pole $S_2$ of the magnet 42 is disposed at a position opposite to the photosensitive drum 1. The developing pole $S_2$ forms a magnetic field in the neighborhood of a developing region between the developing sleeve 41 and the photosensitive drum 1, and a magnetic brush of the two-component developer 49 is formed by the magnetic field.

A regulating blade 45 is disposed above the developing sleeve 41 so as to regulate the layer thickness of the developer 49 on the developing sleeve 41. The regulating blade 45, when composed of a magnetic material, is disposed to have a lowermost end with a gap from the sleeve 41 surface of 30–1000 $\mu$m, preferably 400–900 $\mu$m. If the gap is less than 300 $\mu$m, the magnetic carrier is liable to plug the gap, thus causing a coating irregularity of the developer layer, and also fail in forming a developer layer required for good development, thus resulting in developed images with a low density and much irregularity. In order to prevent an irregular coating due to unnecessary particles possibly contained in the developer (so-called "blade plugging"), a gap of 400 $\mu$m or larger is preferred. If the gap exceeds 1000 $\mu$m, an excessively large amount of developer is applied on the developing sleeve 41, thus failing to effect a desired developer layer thickness regulation, the attachment of the magnetic carrier onto the photosensitive drum 1 is increased, and the triboelectric charge of the toner is liable to be insufficient and result in fog due to weaker developer regulation by the magnetic blade 45.

A layer of magnetic carrier formed on the developing sleeve 41 moves along with the rotation of the developing sleeve 41, but the movement speed becomes slower as the distance from the sleeve 41 surface is increased by a balance between a constraint force based on magnetic force and gravity and a driving force due to the rotation of the sleeve 41. Some portion of the carrier can drop off the sleeve due to the gravity.

Accordingly, by appropriately selecting the positions of the poles $N_1$ and $N_2$ and the magnetic property and flowability of the magnetic carrier particles, the magnetic carrier layer moves toward the pole $N_1$ at a faster speed as it approaches the sleeve surface to form a moving layer. By the movement of the magnetic carrier along with the rotation of the developing sleeve 41, the developer 49 is conveyed to the developing region to be used for development. The toner scattering is suppressed by an upstream-side regulating member 51 and a downstream-side regulating member 52.

Various properties and parameters described herein for characterizing the present invention are based on values respectively measured in the following manner.

Particle Size Distribution of a Toner

The particle size distribution may be measured by using a Coulter counter TA-II or Coulter Multisizer (available from Coulter Electronics Inc.).

For measurement, a 1%-NaCl aqueous solution (e.g., ISOTON R-II (available from Coulter Scientific Japan K.K.)) as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40.3 μm (13 channels) by using the above-mentioned Coulter counter with a 100 μm-aperture to obtain a volume-basis distribution and a number-basis distribution. From the results of the volume-basis distribution and number-basis distribution, parameters characterizing a toner may be obtained. More specifically, the weight-basis average particle size ($D_4$) may be obtained from the volume-basis distribution while a central value in each channel is taken as a representative value for each channel.

The above-mentioned 13 channels includes 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.00–25.40 μm: 25.40–32.00 μm; and 32.00–40.30 μm.

Glass Transition Temperature (Tq)

Measurement may be performed in the following manner by using a differential scanning calorimeter (e.g., "DSC-7", available from Perkin-Elmer Corp.).

A sample in an amount of 5–20 mg, preferably about 10 mg, is accurately weighed.

The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a main absorption peak appears in the temperature region of 40–100° C.

In this instance, the glass transition temperature (Tg) is determined as a temperature of an intersection between a DSC curve and an intermediate line passing between the base lines obtained before and after the appearance of the absorption peak.

Molecular Weight Distribution of Polyester Resin

Mn, Mw and Mw/Mn of a polyester resin may be measured by gel permeation chromatography (GPC).

In the GPC apparatus, a column is stabilized in a heat chamber at 40° C., tetrahydrofuran (THF) solvent is caused to flow through the column at that temperature at a rate of 1 ml/min. Ca. 100 μl of a GPC sample is injected into the column for the measurement. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights of ca. $10^2$–$10^7$ available from, e.g., Toso K.K. or Showa Denko K.K. It is appropriate to use at least ca. 10 standard polystyrene samples. The detector may be an RI (refractive index) detector. It is appropriate to use a plurality of commercially available polystyrene gel columns in combination.

Examples thereof may include: a combination of Shodex GPC KF-801, 802, 803, 804, 805, 806, 807 and 800P, available from Showa Denko K.K.; and a combination of TSK gel G1000H ($H_{XL}$), G2000H ($H_{XL}$), G3000H ($H_{XL}$), G4000H ($X_{XL}$), G5000H ($H_{XL}$), G6000H ($H_{XL}$), G7000H ($H_{XL}$) and TSK quadocolumn, available from Toso K.K.

The sample may be prepared in the following manner.

A sample is placed in THF and, after standing for several hours, mixed sufficiently with the THF by shaking until the coalescent sample disappears, followed further by standing for at least 24 hours. Then, the sample solution is passed through a membrane filter having a pore size of 0.45–0.50 μm (e.g., "Maishori Disk H-25-5", available from Toso K.K.; and "Ekikuro Disk 25CR", available from German Science (Japan K.K.) to provide a GPC sample. The sample concentration may be adjusted to provide a resin concentration of 0.5–5 mg/ml.

Acid Value

2–10 g of a sample resin is accurately weighted into a 200 to 300 ml-Erlenmeyer flask, and ca. 50 ml of methanol/toluene (=30/70) mixture solvent is added thereto to dissolve the sample resin. In case where the solubility appears to be low, a small amount of acetone may be added. The solution is titrated with a preliminarily standardized 0.1 normal-potassium hydroxide alcohol solution in the presence of a 0.1%-Bromothymol Blue/Phenol Red mixture indicator. From the consumed volume of the KOH-alcohol solution (KOH (ml)), the acid value is calculated by the following equation:

$$\text{Acid value (mgKOH/g)}=[\text{KOH(ml)}\times N\times 56.1]/\text{sample weight},$$

wherein N represents a factor of the 0.1 normal KOH solution.

Triboelectric Chargeability

Figure 3:
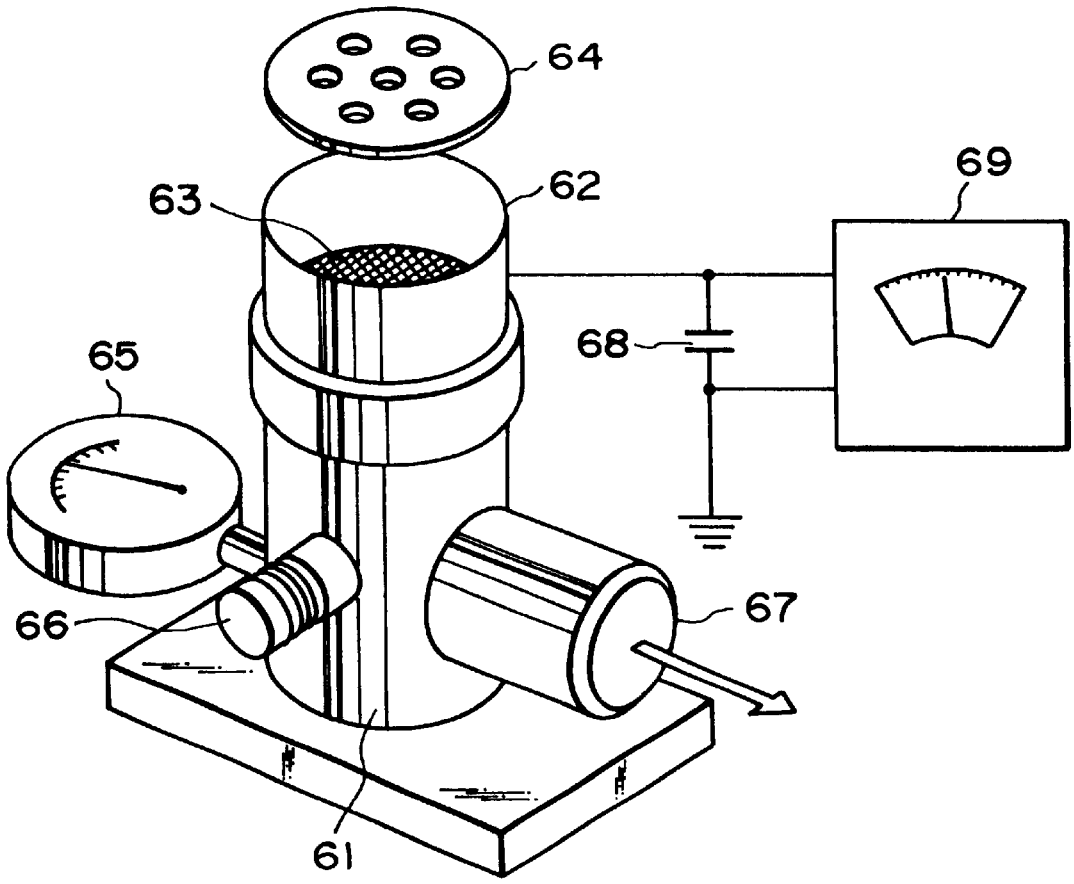
FIG. 3 is a perspective illustration of an apparatus for measuring a triboelectric chargeability of a toner and an external additive.

FIG. 3 is an illustration of an apparatus for measuring a toner triboelectric charge. A developer sampled from the surface of a developing sleeve of a copying machine or a printer, in a weight of ca. 0.5–1.5 g, is placed in a metal measurement vessel 62 bottomed with a 500-mesh screen 63 and then covered with a metal lid 64. The weight of the entire measurement vessel 62 at this time is weighed at $W_1$ (g). Then, an aspirator 61 (composed of an insulating material at least with respect to a portion contacting the measurement vessel 62) is operated to suck the toner through a suction port 67 while adjusting a gas flow control valve 66 to provide a pressure of 250 mmAg at a vacuum gauge 65. Under this state, the toner is sufficiently removed by sucking, preferably for 2 min.

The potential reading on a potentiometer 69 at this time is denoted by V (volts) while the capacitance of a capacitor 68 is denoted by C (mF), and the weight of the entire measurement vessel is weighed at $W_2$ (g). Then, the triboelectric charge Q (mC/kg) of the sample toner is calculated by the following equation:

$$Q(mC/\text{kg})=C\times V/(W_1-W_2).$$

The measurement is performed in an environment of 23° C. and 60%RH.

Average Particle Size of Inorganic Fine Powder (Dp1)

As for the measurement of primary particle size of inorganic fine powder before external addition to a toner, sample inorganic fine powder is observed through a transmission electron microscope, and 300 particles enlarged at a magnification of $3\times10^4$–$5\times10^4$ and having a particle size (longer-axis diameter) of at least 0.001 $\mu$m are selected in the view field to be measured with respect to particle sizes, from which an average primary particle size (longer-axis diameter) is obtained.

As for the measurement of a dispersed particle size on toner particles, sample inorganic fine powder on the toner particles is observed through a scanning electron microscope, and 300 particles thereof enlarged at a magnification of $3\times10^4$–$5\times10^4$ and selected in the view field to be measured with respect to particle sizes while qualitatively identifying the particles by an X-ray microanalyzer, thereby obtaining an average particle size (longer-axis diameter).

If a sample powder has such a small particle size that the magnification of $5\times10^4$ is insufficient for the above determination, a further large magnification is adopted so as to provide a principal particle size on an enlarged photograph reaches 5 mm or larger to effect the above determination of the average particle size.

BET Specific Surface Area of Inorganic Fine Powder

BET specific surface area ($S_{BET}$) of inorganic fine powder is measured by using a specific surface area meter (e.g., "Autosorb 1" available from QUANTACHROME Co.) according to the BET multi-point method. Before the measurement, ca. 0.1 g of a sample weighed in a cell is subjected to evacuation for at least 12 hours at 40° C. under a vacuum of below $1.0\times10^{-3}$ mmHg. Then, the nitrogen adsorption according to the multi-point method is performed at the liquid nitrogen temperature.

50%-particle Size of Carrier

A micro-track particle size analyzer ("SRA Type", available from Nikkiso K.K.) is used for measurement in the range of 0.7–700 $\mu$m to determine a 50% particle size $D_{50\%}$ of a sample carrier based on a volumetric distribution.

EXAMPLES

Hereinbelow, the present invention will be described more specifically based on Examples and Comparative Examples.

First of all, some examples of preparation of inorganic fine powder will be described.

Synthesis Example 1

Into 3 liter of 2M-ammonium bicarbonate aqueous solution, 2 liter of 0.2M-ammonium aluminum alum aqueous solution was added dropwise at a rate of 0.8 liter/hour. while maintaining the liquid temperature at 35° C. for reaction under stirring. The resultant precipitate of $NH_4AlCO_3(OH)_2$ was recovered by filtration, dried and calcined at ca. 900° C. to obtain γ-aluminum fine powder, of which the γ-crystal form was confirmed by x-ray analysis.

Then, the alumina fine powder was uniformly dispersed in toluene, and under stirring, isobutyltrimethoxysilane as a silane coupling agent added dropwise in a solid matter amount of 30 wt. parts per 100 wt. parts of the alumina fine powder so as not to cause coalescence of the fine powder. Then, the solid matter was recovered by filtration, dried to remove the solvent and baked at 180° C. for 2 hours, followed by sufficient disintegration to obtain objective surface-hydrophobized inorganic fine powder (hereinafter called "Treated Inorganic powder 1"), which exhibited an average primary particle size (Dp1) of 0.005 $\mu$m, a BET specific surface area ($S_{BET}$) of 210 $m^2/g$ and a metanol hydrophobicity (HPMe) of 66%.

Synthesis Example 2

$AlCl_3$ was subjected to gaseous phase sintering at a relatively high temperature to form γ-form hydrophilic alumina fine powder, which was subjected to a surface hydrophobization treatment in a similar manner as in Synthesis Example 1 except that the treating amount of isobutyltrimethoxysilane was reduced to 15 wt. parts, thereby obtaining Treated Inorganic powder 2.

Synthesis Example 3

100 wt. parts of anatase-form titanium oxide (Dp1=0.03 $\mu$m, $S_{BET}$=145 $m^2/g$) formed through the sulfuric acid process was surface-hydrophobized with 18 wt. parts (solid matter) of isobutyltrimethoxy-silane otherwise in a similar manner as in Synthesis Example 1 to obtain Treated Inorganic powder 3.

Synthesis Example 4

100 wt. parts of commercially available silica fine powder ($S_{BET}$=260 $m^2/g$) was surface-hydrophobized with 20 wt. parts of hexamethyl-disilazane in an ordinary manner to obtain Treated Inorganic powder 4.

Synthesis Example 5

100 wt. parts of rutile-form titanium oxide (Dp1=0.3 $\mu$m) obtained through sintering at a relatively high temperature was surface-hydrophobized with 10 wt. parts of n-butyltrimethoxysilane to obtain Treated Inorganic powder 5.

Synthesis Example 6

Anatase-form titanium oxide used in Synthesis Example 3 was used as it was as Inorganic powder 6 (un-treated) without the surface hydrophobization treatment.

The properties of the thus-obtained (Treated) Inorgaic powders 1–6 are inclusively shown in the following Table 1.

TABLE 1

| (Treated) Inorganic powders | | | | | |
|---|---|---|---|---|---|
| Inorganic powder | Base material | Treating agent * | Dp1 (μm) | $HP_{Me}$ (%) | $S_{BET}$ ($m^2/g$) |
| 1 | alumina | IBTMS | 0.005 | 66 | 210 |
| 2 | alumina | IBTMS | 0.02 | 65 | 110 |
| 3 | titania | IBTMS | 0.03 | 66 | 130 |
| 4 | silica | HMDSZ | 0.005 | 65 | 230 |
| 5 | titania | NBTMS | 0.3 | 58 | 25 |
| 6 | titania | none | 0.03 | 0 | 145 |

* IBTMS = isobutyltrimethoxysilane
HMDSZ = hexamethyldisilazane
NBTMS = n-butyltrimethoxysilane

Binder Resins

Polyester resin 1 was prepared through polycondensation of monomers shown below.

| | |
|---|---|
| Polyoxypropylene(2.2)-2,2-bis(4-hydroxyphenyl)propane | 30 mol. % |
| Terephthalic acid | 70 mol. % |
| Fumaric acid | 70 mol. % |
| Trimellitic acid | 0.05 mol. % |

Physical properties of Polyester resin 1 as Binder resin 1 to be used in Example 1 described hereinafter are shown in Table 2 together with other Binder Resin.

TABLE 2

| Binder resins | | | | | |
|---|---|---|---|---|---|
| | | Properties | | | |
| Binder resin | Identity * | Acid value (mg KOH/g) | Tg (° C.) | Mn | Mw |
| 1 | Polyester resin 1 | 10.5 | 56 | 4000 | 10500 |
| 2 | Polyester resin 2 | 2.3 | 59 | 4500 | 12500 |
| 3 | Polyester resin 3 | 46.5 | 63 | 4800 | 15500 |
| 4 | Styrene-acrylate resin 1 | 13.2 | 63 | 6000 | 18800 |
| 5 | Polyester resin 4 | 1.9 | 62 | 5200 | 18600 |
| 6 | Polyester resin 5 | 55.2 | 59 | 5800 | 22200 |

* Polyester resin 2 was a polycondensation product of polyoxypropylene (2.2)-bis(4-hydroxyphenyl)propane, fumaric acid and trimellitic acid.

Polyester resin 3 was a polycondensation product of polyoxypropylene (2.2)-2,2-bis(4-hydroxyphenyl)propane, terephthalic acid, fumaric acid and trimellitic acid.

Styrene-acrylate resin 1 was a copolymer of styrene, n-butyl acrylate and mono-n-butyl maleate.

Polyester resin 4 was a polycondensation product of Polyoxypropylene (2.2)-bis(4-hydroxyphenyl)propane, polyoxyethylene(2.0)-bis(4-hydroxyphenyl)propane, terephthalic acid, fumaric acid and trimellitic acid.

Polyester resin 5 was a polycondensation product of polyoxypropylene(2.2)-bis(4-hydroxyphenyl)-propane, terephthalic acid, fumaric acid, and trimellitic acid.

Example 1

| | |
|---|---|
| Polyester resin 1 | 100 wt. parts |
| Copper phthalocyanine pigment (C.I. Pigment Blue 5:3) | 4 wt. parts |
| Organic zirconium compound (38) (Structure of which is indicated hereinbefore) | 4 wt. parts |

The above ingredients were sufficiently preliminarily blended in a Henschel mixer and melt-kneaded through a twin-screw extruder, followed by cooling, crushing by a hammer mill into sizes of ca. 1–2 mm and fine pulverization by means of an air jet-type pulverizer. The fine pulverizate was classified to obtain cyan toner particles having a weight-average particle size (D4) of ca. 6.5 μm.

100 wt. parts of the thus-obtained cyan toner particles and 1.2 wt. parts of Treated inorganic powder 1 obtained in Synthesis Example 1 were blended in a Henschel mixer to prepare Cyan Toner A exhibiting D4=ca. 6.5 μm. As a result of observation of Cyan Toner A through a scanning electron microscope (SEM), the particles of Treated inorganic powder were uniformly dispersed in a primary particle state and attached onto the surface of toner particles.

6.0 wt. parts of Cyan Toner A was blended with a resin-coated carrier (Carrier A) having a 50%-particle size ($D_{50\%}$) of 50 μm and comprising Cu—Zn—Fe-based ferrite carrier core coated with 0.35 wt. % of styrene-methyl methacrylate copolymer (copolymerization weight ratio (CP wt. ratio)=65:35) to provide totally 100 wt. parts of a two-component developer (Cyan Developer A) having a toner concentration of 6.0 wt. %.

The above-prepared Cyan Developer A was charged in a cyan developing apparatus 4C of a commercially available plain paper full-color copying machine ("Color Laser Copier 800", mfd. by Canon K.K.) having a structure as shown in FIG. 1 and subjected to a continuous copying test. The copying machine used a developing bias voltage comprising a prescribed DC voltage superposed with a blank-AC voltage waveform including alternately a two cycle-AC unit of rectangular waves at a frequency (f)=12000 Hz and a peak-to-peak voltage (Vpp)=2000 volts and a unit of blank period of 500 μsec (corr. to 2000 Hz). The images obtained at initial stage exhibited clear colors of excellent saturation.

As a result of continuous copying on $5\times10^4$ sheets in a normal temperature/normal humidity environment (23° C./65%RH), cyan color images free from fog and faithfully reproducing the original were obtained. The developer conveyance and toner concentration detection in the copying machine were well performed to provide stable image densities. At a fixing temperature of 170° C., no offset onto the fixing roller was observed at all after the continuous copying on $5\times10^4$ sheets as a result of observation of the fixing roller surface after the continuous copying.

The triboelectric charge measurement was performed both in a low temperature/low humidity environment (15° C./10%RH) and in a high temperature/high humidity environment (32.5° C./85%RH), whereby very little difference was observed between these environments.

Further, color images formed on an OHP transparency film exhibited a good transparency and provided clear OHP projected images.

Further, good performances were exhibited with respect to any of toner sticking on the photosensitive drum, charge stability, fixability and continuous image forming performances.

Example 2

Magenta Toner B ($D_4$=6.6 μm) and a corresponding two-component developer were prepared and evaluated in the same manner as in Example 1 except for using 5 wt. parts of a quinacridone-based chromatic colorant (C.I. Pigment Red 122) instead of the copper phthalocyanine pigment.

Example 3

Yellow Toner C ($D_4$=6.5 μm) and a corresponding two-component developer were prepared and evaluated in the same manner as in Example 1 except for using 3.5 wt. parts of a diarylide-based yellow colorant (C.I. Pigment Yellow 17) instead of the copper phthalocyanine pigment.

Examples 4–15

Toner D through O were prepared respectively according to prescriptions shown in Table 3 otherwise in similar manners as in Example 1.

Corresponding two-component developers were prepared from these Toners D through O and evaluated otherwise in similar manners as in Example 1.

For Toner O of Example 15, 0.5 wt. part of Treated inorganic powder 1 was added to 100 wt. parts of the cyan toner particles, and a corresponding two-component developer was prepared to have a toner concentration of 8.0 wt. %.

The results of image forming performance evaluation are inclusively shown in Table 4.

Example 16

6.0 wt. parts of Cyan Toner A prepared in Example 1 was blended with 94 wt. parts of resin-coated carrier (Carrier B) ($D_{50\%}$=50 μm) comprising Cu—Zn—Fe-based ferrite carrier core coated with 0.3 wt. % of a coating mixture of acryl-modified silicone resin and aminopropyltrimethoxysilane (coupling agent) to prepare a two-component developer. The two-component developer was evaluated otherwise in a similar manner as in Example 1.

Comparative Examples 1–3

Comparative Toners P–R and corresponding two-component developer were prepared and evaluated in similar manners as in Example 1 except for using an organic zinc compound (172), an organic iron compound (173) and an organic chromium compound (174), respectively, as shown below instead of the organic zirconium compound (38) used in Example 1.

(172)

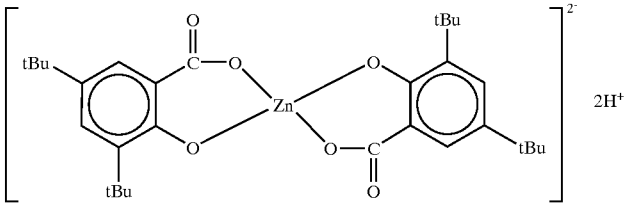

(173)

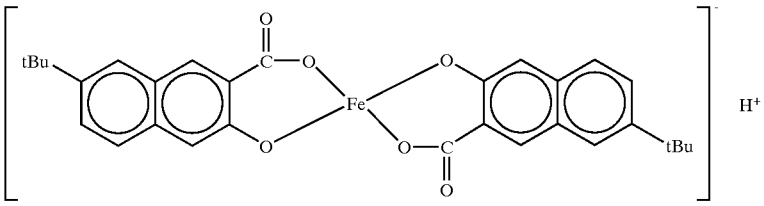

(174)

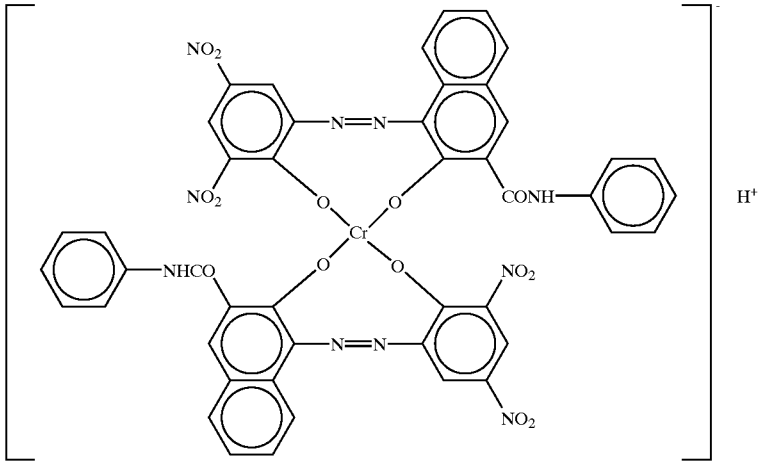

Comparative Examples 4 and 5

Comparative Toners S and T and corresponding two-component developers were prepared according to prescriptions shown in Table 3 otherwise in similar manner as in Example 1. The resultant comparative developers were evaluated in similar manner as in Example 1.

Comparative Example 6

A comparative two-component developer was prepared by blending Toner A with not Carrier A used in Example 1 but a resin-coated carrier (Carrier C) ($D_{50\%}$=72 μm) formed by coating Cu—Zn-Ferrite-based carrier core particles with ca. 0.15 wt. % of styrene-methyl methacrylate copolymer (CP wt. ratio=65:35) so as to provide a toner concentration of 4.0 wt. %, otherwise in a similar manner as in Example 1.

The two-component developer was evaluated in the same manner as in Example 1.

Comparative Example 7

A comparative two-component developer was prepared by blending Toner A with not Carrier A used in Example 1 but a resin-coated carrier (Carrier D) ($D_{50\%}$=19 μm) formed by coating Cu—Zn-Ferrite-based carrier core particles with ca. 0.50 wt. % of styrene-methyl methacrylate copolymer (CP wt. ratio=65:35) so as to provide a toner concentration of 8.0 wt. %, otherwise in a similar manner as in Example 1.

The two-component developer was evaluated in the same manner as in Example 1.

Comparative Example 8

A comparative two-component developer was prepared by blending Toner A with not Carrier A used in Example 1 but an un-coated carrier (Carrier E) ($D_{50\%}$=50 μm) comprising Cu—Zn-Ferrite-based carrier particles so as to provide a toner concentration of 6.0 wt. %, otherwise in a similar manner as in Example 1.

The two-component developer was evaluated in the same manner as in Example 1.

The results of Evaluation of the above-mentioned Examples and Comparative Examples are inclusively shown in Table 4.

TABLE 3

| Toner prescription and particle size ($D_4$) | | | | | | | |
|---|---|---|---|---|---|---|---|
| Ex. or Comp. Ex. | Toner | Carrier | Binder resin | Organic Zr compound (formula No.) | Colorant (C.I.No.) | Inorganic powder | $D_4$ (um) |
| Ex. | | | | | | | |
| 1 | A | A | 1 | 38 | Blue 15:3 | 1 | 6.5 |
| 2 | B | A | 1 | 38 | Red 122 | 1 | 6.6 |
| 3 | C | A | 1 | 38 | Yellow 17 | 1 | 6.5 |
| 4 | D | A | 1 | 48 | Blue 15:3 | 1 | 6.5 |
| 5 | E | A | 1 | 63 | Blue 15:3 | 1 | 6.5 |
| 6 | F | A | 1 | 83 | Blue 15:3 | 1 | 6.5 |
| 7 | G | A | 1 | 38 | Blue 15:3 | 2 | 8.5 |
| 8 | H | A | 2 | 38 | Blue 15:3 | 2 | 8.5 |
| 9 | I | A | 3 | 38 | Blue 15:3 | 2 | 8.5 |
| 10 | J | A | 4 | 38 | Blue 15:3 | 2 | 8.5 |
| 11 | K | A | 1 | 38 | Blue 15:3 | 3 | 6.5 |
| 12 | L | A | 1 | 38 | Blue 15:3 | 4 | 6.5 |
| 13 | M | A | 5 | 38 | Blue 15:3 | 1 | 6.5 |
| 14 | N | A | 6 | 38 | Blue 15:3 | 1 | 6.5 |
| 15 | O | A | 1 | 38 | Blue 15:3 | 1 | 12.3 |
| 16 | A | B | 1 | 38 | Blue 15:3 | 1 | 6.5 |
| Comp. Ex. | | | | | | | |
| 1 | P | A | 1 | Zn (172) | Blue 15:3 | 1 | 6.5 |
| 2 | Q | A | 1 | Fe (173) | Blue 15:3 | 1 | 6.5 |
| 3 | R | A | 1 | Cr (174) | Blue 15:3 | 1 | 6.5 |
| 4 | S | A | 1 | 38 | Blue 15:3 | 5 | 6.5 |
| 5 | T | A | 1 | 38 | Blue 15:3 | 6 | 6.5 |
| 6 | A | C | 1 | 38 | Blue 15:3 | 1 | 6.5 |
| 7 | A | D | 1 | 38 | Blue 15:3 | 1 | 6.5 |
| 8 | A | E | 1 | 38 | Blue 15:3 | 1 | 6.5 |

TABLE 4

| Ex. or | | | 32.5° C./85% RH | | 23° C./65% RH | 15° C./10% RH | | | | |
|---|---|---|---|---|---|---|---|---|---|---|
| Comp. Ex. | Toner | Carrier | I.D. | Scatter | I.D. | I.D. | Halftone | Fog | OHP | Remarks* |
| Ex. | | | | | | | | | | |
| 1 | A | A | 1.8–1.7 | A | 1.7–1.5 | 1.65–1.6 | A | A | A | |
| 2 | B | A | 1.7–1.6 | A | 1.65–1.65 | 1.6–1.55 | A | A | A | |
| 3 | C | A | 1.85–1.75 | A | 1.75–1.85 | 1.76–1.65 | A | A | A | |
| 4 | D | A | 1.75–1.66 | B | 1.70–1.55 | 1.6–1.5 | B | B | A | |
| 5 | B | A | 1.75–1.65 | B | 1.7–1.6 | 1.6–1.45 | B | B | A | |
| 6 | F | A | 1.85–1.7 | B | 1.76–1.55 | 1.65–1.5 | B | B | A | |
| 7 | G | A | 1.85–1.7 | A | 1.75–1.55 | 1.75–1.65 | B | A | A | R1 |
| 8 | H | A | 1.75–1.65 | A | 1.70–1.55 | 1.65–1.4 | B | B | A | R2 |
| 9 | I | A | 1.85–1.76 | C | 1.8–1.7 | 1.75–1.65 | C | B | B | R3 |
| 10 | J | A | 1.75–1.65 | B | 1.65–1.55 | 1.7–1.6 | C | C | B | R2 |
| 11 | K | A | 1.6–1.7 | A | 1.7–1.6 | 1.65–1.6 | A | A | B | |
| 12 | L | A | 1.85–1.7 | C | 1.7–1.8 | 1.65–1.4 | B | C | A | R4 |
| 13 | M | A | 1.7–1.6 | B | 1.7–1.6 | 1.55–1.3 | C | C | B | R4 |
| 14 | N | A | 1.85–1.75 | C | 1.8–1.6 | 1.65–1.5 | C | B | B | R3 |
| 15 | O | A | 1.8–1.7 | A | 1.7–1.6 | 1.7–1.6 | C | A | B | R5 |
| 16 | A | B | 1.8–1.7 | A | 1.7–1.6 | 1.65–1.55 | A | A | A | |

TABLE 4-continued

| Ex. or | | | 32.5° C./85% RH | | 23° C./65% RH | 15° C./10% RH | | | | |
|---|---|---|---|---|---|---|---|---|---|---|
| Comp. Ex. | Toner | Carrier | I.D. | Scatter | I.D. | I.D. | Halftone | Fog | OHP | Remarks* |
| Comp. Ex. | | | | | | | | | | |
| 1 | P | A | 1.8–1.7 | B | 1.7–1.6 | 1.65–1.4 | B | D | B | R6 |
| 2 | Q | A | 1.85–1.7 | D | 1.7–1.6 | 1.6–1.5 | C | C | C | R7 |
| 3 | R | A | 1.8–1.7 | C | 1.7–1.6 | 1.65–1.4 | C | D | C | R8 |
| 4 | S | A | 1.7–1.6 | C | 1.6–1.45 | 1.5–1.2 | D | D | B | R9 |
| 5 | T | A | 1.9–1.75 | D | 1.85–1.7 | 1.8–1.7 | D | D | B | R10 |
| 6 | A | C | 1.7–1.5 | C | 1.6–1.5 | 1.5–1.35 | D | C | B | R11 |
| 7 | A | D | 1.8–1.7 | A | 1.7–1.6 | 1.5–1.4 | B | B | A | R12 |
| 8 | A | E | 1.9–1.7 | D | 1.7–1.6 | 1.7–1.5 | C | C | A | R13 |

*The meanings of R1 to R13 are mentioned at the end of Notes to Table 4 given from the next page.

Notes to Table 4

Details of image forming performance evaluation performed in the above-mentioned Examples and Comparative Examples and evaluation standards for some items shown in Table 9 are supplemented hereinbelow.

(1) Image Density (I.D.)

Image densities were measured by using a Macbeth reflection densitometer (available from Macbeth Co.) with respect to images formed at the initial stage and final stage of the continuous image formation on $5\times10^4$ sheets in each of the high temperature/high humidity, normal temperature/normal humidity and low temperature/low humidity environments, and the initial and final image density values are indicated for each environment in Table 4.

(2) Toner scattering (Scatter)

The appearance of the interior of the copying apparatus after the continuous image formation on $5\times10^4$ sheets in the high temperature/high humidity environment was evaluated according to the following standard.

A: Toner scattering was not observed.

B: Slight soiling with scattered toner was observed around the developing apparatus.

C: Soiling wit h scattered toner was observed around the developing apparatus.

D: Serious soiling with scattered toner was observed around the developing apparatus.

(3) Halftone Reproducibility (Halftone)

A photographic image was reproduced on a copied sheet in a low temperature/low humidity environment, and the reproduced image was evaluated according to the following standard.

A: The photographic image was faithfully reproduced.

B: The photographic image was well reproduced while the reproduced image slightly lacked smoothness.

C: The reproduced image lacked Smoothness of the photographic image.

D: The reproduction of the photographic image was failed.

(4) Fog

The whiteness of a white background portion of a copied image sheet obtained after 5000 sheets of continuous copying in a low temperature/low humidity environment was measured by a reflectometer (mfd. by Tokyo Denshoku K.K.), and was compared with the whiteness of a blank paper for the copying to determine a difference in whiteness as fog %. From the fog % level, the evaluation was performed according to the following standard.

A: Very good (<1.0%)

B: Good (≧2.0% and <3.0%)

C: Fair (≧2.0% and <3.0%)

D: Poor (≧3.0%)

(5) Transparency of Image on an OHP Film (OHP)

A color image formed on an OHP transparency film was projected on a screen by using a commercially available overhead projector, and the projected image was evaluated according to the following standard.

A: The projected image was clear, free from bright-dark irregularity and excellent in color reproducibility (Good).

B: Slight bright-dark irregularity was observed but at a practically acceptable level (Fair).

C: Bright-dark irregularity was observed and color reproducibility was insufficient (Poor).

** The symbols indicated in the items of Remarks respectively have the following meanings.

R1: The halftone reproducibility was somewhat inferior than Example 1.

R2: Some liability of charge-up was observed in the low temperature/low humidity environment.

R3: Some toner scattering in the low temperature/low humidity environment but within a practically acceptable level.

R4: Slight liability of charge-up was observed and fog became gradually noticeable with a continuation of image formation in the low temperature/low humidity environment.

R5: Halftone reproducibility and uniformity were inferior but within a practically acceptable level.

R5: Liability of charge-up and fog became noticeable with continuation of image formation in the low temperature/low humidity environment.

R7: Toner scattering observed and became worse with continuation of image formation in the high temperature/high humidity environment.

R8: Fog became worse with continuation of image formation.

R9: A lower level of halftone reproducibility.

R10: Toner scattering was observed from the initial stage in the high temperature high humidity environment.

R11: Inferior halftone uniformity.

R12: Noticeable carrier attachment onto the image part.

R13: Noticeable toner scattering in the high temperature/high humidity environment reproducibility became worse with continuation of image formation.

What is claimed is:

1. An image forming method, comprising:

(I) a charging step of charging an image-bearing member, (II) a latent image-forming step of forming an electrostatic latent image on the charged image-bearing member, (III) a developing step of developing the latent image on the image-bearing member with a magnetic brush of a two-component developer on a developing sleeve having a magnet therein while applying a DC voltage superposed with an AC voltage, wherein the two-component developer comprises a negatively chargeable non-magnetic toner and a resin-coated magnetic carrier, to form a toner image on the image-bearing member, and (IV) a transfer step of transferring the toner image onto a transfer-receiving material via or without via an intermediate transfer member, wherein the toner comprises at least a binder resin, a colorant and an organic metal compound, the organic metal compound is an organic zirconium compound comprising a structure represented by the following formula (3), (4), (5), (6), (7), (8), (34), (34-1) (35), (36), (36-1) or (37):

(3)

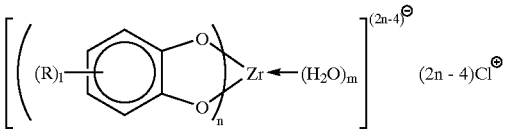

(4)

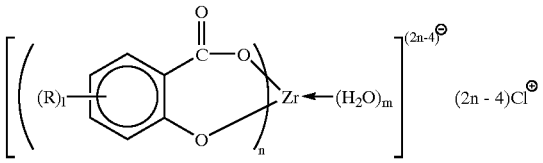

(5)

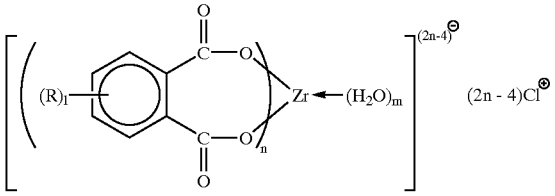

wherein for the formula (3), (4), or (5) R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring; a plurlity of R can be identical or different; C1 denotes a monovalent cation of hydrogen, alkaline metal, ammonium or alkylammonium; l is an integer of 1–8; n is 2, 3 or 4; m is 0, 2 OR4; a number (n) of ligands can be identical or different in each complex or complex salt of a formula; with the proviso that each complex or complex salt of a formula can be a mixture of complex compounds having mutually different n or/and m, or a mixture of complex sats having mutually different counter ions C1

(6)

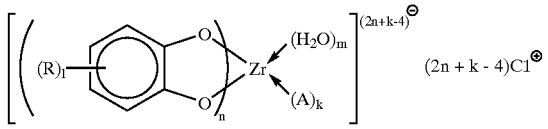

(7)

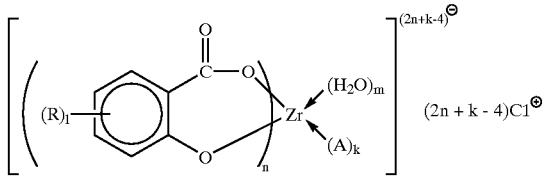

(8)

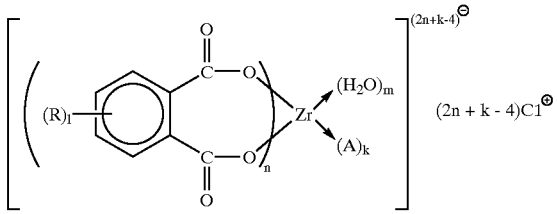

wherein for the formula (6), (7) or (8) R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring; a plurality of R can be identical or different; A denotes an anion of halogen, hydroxyl, carboxylate, carbonate, nitrate, sulfate, cyano or thiocyano, a plurality of A can be identical or different; C1 denotes a monovalent cation of hydrogen, alkaline metal, ammonium or alkylammonium; l is an integer of 1–8; n is 1, 2, 3 or 4; m is 0, 2 or 4; k is 1, 2, 3, 4, 5 or 6; a number (when n≧2) of ligands can be identical or different in each complex or complex salt of a formula; with the proviso that each complex or complex salt of a formula can be a mixture of complex compounds having mutually different n or/and m, or a mixture of complex salts having mutually different counter ions C1 or/and anions A; and with the proviso that in case of A is a divalent anion, each k in terms of (2n+k−4) is replaced by 2 k, (34)

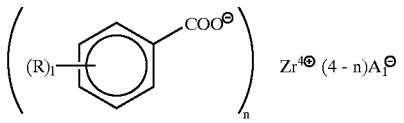

(34-1)

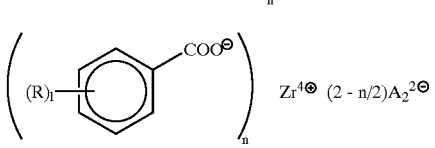

(35)

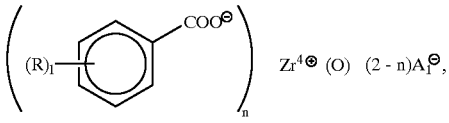

wherein each R denotes hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amide or carbamoyl; l is an integer of 1–8; a plurality (when l≧2) of R can be mutually connected to form an alicyclic ring, aromatic ring or heterocyclic ring, a plurality of R can be identical to or different from each other; $A_1$ denotes a monovalent anion of halogen, hydroxyl, nitrate or carboxylate; $A_2$ denotes a divalent anion of sulfate, hydrogenphosphate or carbonate; and n is 1, 2, 3 or 4 with the proviso that in each formula, a plurality of anions of anions $A_1$, anions $A_2$ or acid ions of aromatic carboxylic acids, may be identical or different; and that each metal salt of a formula can be a mixture of different salts having different numbers of n (36)

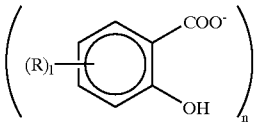

$Zr^{4\oplus}$ $(4-n)A_1^{\ominus}$ or (36-1)

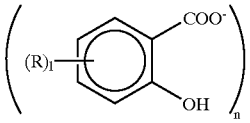

$Zr^{4\oplus}$ $(2-n/2)A_2^{2\ominus}$ (37)

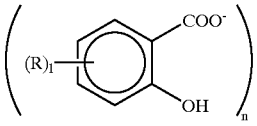

$Zr^{4\oplus}$ (O) $(2-n)A_1^{\ominus}$, wherein each R denotes hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amide or carbamoyl; l is an integer of 1–8; a plurality (when l≧2) of R can be mutually connected to form an alicyclic ring, aromatic ring or heterocyclic ring; a plurality of R can be identical to or different from each other; $A_1$ denotes a monovalent anion of halogen, hydroxyl, nitrate or carboxylate; $A_2$ denotes a divalent anion of sulfate, hydrogenphosphate or carbonate; and n is 1, 2, 3 or 4 with the proviso that in each formula, a plurality of anions of anions $A_1$, anions $A_2$ or acid ions of aromatic carboxylic acids, may be identical or different; and that each metal salt of a formula can be a mixture of different salts having different numbers of n, wherein in each of the above formulas when said plurality of R are mutually linked to form an aromatic ring, said aromatic ring is benzene, the toner includes an external additive comprising hydrophobized inorganic fine powder having an average primary particle size of 0.001–0.2 μm, and the resin-coated carrier comprises (i) carrier core particles and (ii) 0.01–5 wt. % thereof of a coating material, said coating material comprising a resin for surface-coating the carrier core particles, wherein said resin-coated carrier has a 50%-particle size of 20–70 μm.

2. The method according to claim 1, wherein the toner comprises toner particles containing therein the binder resin, the colorant and the organic zirconium compound in an amount of 0.1–10 wt. parts per 100 wt. parts of the binder resin.

3. The method according to claim 2, wherein the organic zirconium compound is contained in 0.5–5 wt. parts per 100 wt. parts of the binder resin.

4. The method according to claim 1, wherein the toner comprises toner particles comprising at least the binder resin and the colorant, and the organic zirconium compound externally added to the toner particles in an amount of 0.01–5 wt. parts per 100 wt. parts of the binder resin.

5. The method according to claim 1, wherein the binder resin of the toner comprises a polyester resin.

6. The method according to claim 5, wherein the polyester resin has a glass transition temperature of 50–70° C.

7. The method according to claim 5, wherein the polyester resin has a glass transition temperature of 52–68° C.

8. The method according to claim 5, wherein the polyester resin has a molecular weight distribution a s measured by gel permeation chromatography (GPC) including a number-average molecular weight (Mn) of $1.5\times10^3$–$5\times10^4$, a weight-average molecular weight (Mw) of $6\times10^3$–$10^5$, and a ratio Mw/Mn of 2–8.

9. The method according to claim 8, wherein the polyester resin has a molecular weight distribution as measured by GPC including Mn of $2\times10^3$–$2\times10^4$, Mw of $10^4$–$9\times10^4$, and a ratio Mw/Mn of 2–8.

10. The method according to claim 1, wherein the binder resin has an acid value of 2.0–50.0 mgKOH/g.

11. The method according to claim 1, wherein the binder resin has an acid value of 3.0–40.0 mgKOH/g.

12. The method according to claim 1, wherein the toner is a color toner containing a chromatic colorant.

13. The method according to claim 1, wherein the toner has a weight-average particle size of 3.0–15.0 μm.

14. The method according to claim 1, wherein the toner has a weight-average particle size of 4.0–12.0 μm.

15. The method according to claim 1, wherein the inorganic fine powder comprises titanium oxide fine powder or alumina fine powder.

16. The method according to claim 1, wherein the inorganic fine powder has been hydrophobized with a silane compound.

17. The method according to claim 1, wherein the inorganic fine powder has an average primary particle size of 0.005–0.1 μm.

18. The method according to claim 1, wherein the toner includes 0.2–5.0 wt. parts of the inorganic fine powder per 100 wt. parts of toner particles.

19. The method according to claim 1, wherein the toner includes 0.3–3.0 wt. parts of the inorganic fine powder per 100 wt. parts of toner particles.

20. The method according to claim 1, wherein the resin-coated carrier contains 0.1–1 wt. % of the coating material.

21. The method according to claim 1, wherein the coating material comprises at least one species of resin selected from the group consisting of polytetrafluoroethylene, polymonochlorotrifluoroethylene, polyvinylidene fluoride, silicone resin, polyester resin, styrene resin, acrylic resin, polyamide, polyvinyl butyral and aminoacrylate resin.

22. The method according to claim 1, wherein the developer contains the toner at a concentration of 2–15 wt. %.

23. The method according to claim 1, wherein the developer contains the toner at a concentration of 3–13 wt. %.

* * * * *

UNITED STATES PATENT AND TRADEMARK OFFICE

CERTIFICATE OF CORRECTION

PATENT NO. : 6,514,654 B1 
DATED : February 4, 2003
INVENTOR(S) : Makoto Kanbayashi et al.

It is certified that error appears in the above-identified patent and that said Letters Patent is hereby corrected as shown below:

Title Page ,
Item [56], References Cited, FOREIGN PATENT DOCUMENTS, "57-124357 8/1987" should read -- 57-124357 8/1982 --.

Column 6,
Line 45, "$C2^{\oplus}$" should read --$C2^{2\oplus}$ --.

Column 24,
Formula 84,

"

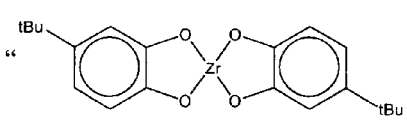

(84)

"

should read

--

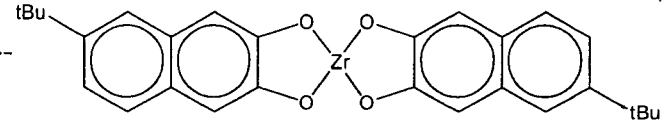

(84)

--.

Column 28,
Formula 111, "$4^-$" should read -- $2^-$ --; and
Formula 115, "$HO^-$" should read -- $OH^-$ --.

Column 33,
Formula 161, "$(OH^-)_S$" should read -- $(OH^-)_3$ --.

Column 34,
Formula 160, "$(OH^-)_S$" should read -- $(OH^-)_3$ --.

Column 41,
Line 46, "rough." should read -- rough --.

Column 47,
Line 29, "apparatus" should read -- apparatus 4 --.

Column 48,
Line 8, "or." should read -- or --.

Column 50,
Line 27, "G4000H ($X_{XL}$)," should read -- G4000H ($H_{XL}$), --.

UNITED STATES PATENT AND TRADEMARK OFFICE

CERTIFICATE OF CORRECTION

PATENT NO. : 6,514,654 B1 
DATED : February 4, 2003
INVENTOR(S) : Makoto Kanbayashi et al.

It is certified that error appears in the above-identified patent and that said Letters Patent is hereby corrected as shown below:

Column 52,
Line 7, "0.8 liter/hour." should read -- 0.8 liter/hour --; and
Line 26, "(HPMe)" should read -- ($HP_{Me}$) --.

Column 59,
Line 42, "wit h" should read -- with --.

Column 61,
Line 62, "2 OR4;" should read -- 2 or 4; --; and
Line 66, "sats" should read -- salts --.

Column 63,
Line 12, "n" should read -- n, --.

Column 64,
Line 13, "a s" should read -- as --.

Signed and Sealed this

Eighteenth Day of November, 2003

JAMES E. ROGAN
*Director of the United States Patent and Trademark Office*